US010559168B2

(12) United States Patent
George et al.

(10) Patent No.: US 10,559,168 B2
(45) Date of Patent: Feb. 11, 2020

(54) PLAYER TRACKING SYSTEM AND METHODS OF OPERATING SAME

(71) Applicant: Konami Gaming, Inc., Las Vegas, NV (US)

(72) Inventors: Jeffrey George, Las Vegas, NV (US); Michael Crittenden, Henderson, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 196 days.

(21) Appl. No.: 15/876,861

(22) Filed: Jan. 22, 2018

(65) Prior Publication Data

US 2018/0211485 A1 Jul. 26, 2018

Related U.S. Application Data

(60) Provisional application No. 62/450,432, filed on Jan. 25, 2017.

(51) Int. Cl.
*G07F 17/32* (2006.01)

(52) U.S. Cl.
CPC ..... *G07F 17/3255* (2013.01); *G07F 17/3216* (2013.01); *G07F 17/3223* (2013.01); *G07F 17/3239* (2013.01)

(58) Field of Classification Search
CPC ..... G07F 17/3244; G07F 17/3255
See application file for complete search history.

(56) References Cited

U.S. PATENT DOCUMENTS

| | | | | |
|---|---|---|---|---|
| 5,655,961 | A | 8/1997 | Acres et al. | |
| 7,303,475 | B2 | 12/2007 | Britt et al. | |
| 2004/0032086 | A1* | 2/2004 | Barragan | G07F 17/32 273/292 |
| 2011/0111843 | A1* | 5/2011 | Nicely | G07F 17/32 463/27 |

* cited by examiner

*Primary Examiner* — James S. McClellan
(74) *Attorney, Agent, or Firm* — Howard & Howard Attorneys PLLC

(57) ABSTRACT

A casino management networked computer system is described. The networked computer system includes a database server computer and an application server computer coupled to the database server computer and to a plurality of gaming devices. The database server processor is programmed to generate and store a program file including a patron logic matrix that includes data records of patron ranking information included in the spreadsheet. Each data record includes a market definition value, a patron ranking value, a theoretical loss value, and a comp reinvestment data. The application processor is programmed to calculate patron comp point values based on the comp reinvestment data and patron wager data included in a patron data record.

20 Claims, 17 Drawing Sheets

82

| 84 | | 86 | | | 88 | | |
|---|---|---|---|---|---|---|---|
| 106 / 114/116 | 118/120 | 122/124 | 126/128 | 130/132 | 134/136 | 138/140 | 142/144 |
| PATRON RANKING | | RANKING CALCULATION | | | COMPING REINVESTMENT | | |
| Market ID | Ranking | ADT Criteria | Total Theo Criteria | Ranking Days Evaluated | Slot Reinv % | TG Reinv % | Comp Days Evaluated |
| Inner | R1+ | 1,250 | 37,500 | 182 | 15.0% | 0.2 | 182 |
| Inner | R1 | 750 | 22,500 | 182 | 15.0% | 0.2 | 182 |
| Inner | R2 | 500 | 13,500 | 182 | 15.0% | 0.2 | 182 |
| Inner | R3 | 400 | 9,000 | 182 | 12.5% | 0.2 | 182 |
| Inner | R4 | 300 | 6,750 | 182 | 10.0% | 0.2 | 182 |
| Inner | R5 | 250 | 4,500 | 182 | 7.0% | 0.2 | 182 |
| Inner | R6 | 200 | 3,000 | 182 | 6.5% | 0.2 | 182 |
| Inner | R7 | 150 | 1,800 | 182 | 6.0% | 0.2 | 182 |
| Inner | R8 | 50 | 500 | 182 | 5.0% | 0.2 | 182 |
| Inner | R9 | 0 | 0 | 182 | 0.0% | 0.2 | 182 |
| Mid | R1+ | 1,250 | 37,500 | 182 | 15.0% | 0.2 | 182 |
| Mid | R1 | 750 | 22,500 | 182 | 15.0% | 0.2 | 182 |
| Mid | R2 | 500 | 13,500 | 182 | 15.0% | 0.2 | 182 |
| Mid | R3 | 400 | 9,000 | 182 | 12.5% | 0.2 | 182 |
| Mid | R4 | 300 | 6,750 | 182 | 10.0% | 0.2 | 182 |
| Mid | R5 | 250 | 4,500 | 182 | 7.0% | 0.2 | 182 |
| Mid | R6 | 200 | 3,000 | 182 | 6.5% | 0.2 | 182 |
| Mid | R7 | 150 | 1,800 | 182 | 6.0% | 0.2 | 182 |
| Mid | R8 | 50 | 500 | 182 | 5.0% | 0.2 | 182 |
| Mid | R9 | 0 | 0 | 182 | 0.0% | 0.2 | 182 |
| Feeder | R1+ | 1,250 | 37,500 | 270 | 15.0% | 0.2 | 182 |
| Feeder | R1 | 750 | 22,500 | 270 | 15.0% | 0.2 | 182 |
| Feeder | R2 | 500 | 13,500 | 270 | 15.0% | 0.2 | 182 |
| Feeder | R3 | 400 | 9,000 | 270 | 12.5% | 0.2 | 182 |
| Feeder | R4 | 300 | 6,750 | 270 | 10.0% | 0.2 | 182 |
| Feeder | R5 | 250 | 4,500 | 270 | 7.0% | 0.2 | 182 |
| Feeder | R6 | 200 | 3,000 | 270 | 6.5% | 0.2 | 182 |
| Feeder | R7 | 150 | 1,800 | 270 | 6.0% | 0.2 | 182 |
| Feeder | R8 | 50 | 500 | 270 | 5.0% | 0.2 | 182 |
| Feeder | R9 | 0 | 0 | 270 | 0.0% | 0.2 | 182 |
| Outer | R1+ | 1,250 | 37,500 | 450 | 15.0% | 0.2 | 182 |
| Outer | R1 | 750 | 22,500 | 450 | 15.0% | 0.2 | 182 |
| Outer | R2 | 500 | 13,500 | 450 | 15.0% | 0.2 | 182 |
| Outer | R3 | 400 | 9,000 | 450 | 12.5% | 0.2 | 182 |
| Outer | R4 | 300 | 6,750 | 450 | 10.0% | 0.2 | 182 |
| Outer | R5 | 250 | 4,500 | 450 | 7.0% | 0.2 | 182 |
| Outer | R6 | 200 | 3,000 | 450 | 6.5% | 0.2 | 182 |
| Outer | R7 | 150 | 1,800 | 450 | 6.0% | 0.2 | 182 |
| Outer | R8 | 50 | 500 | 450 | 5.0% | 0.2 | 182 |
| Outer | R9 | 0 | 0 | 450 | 0.0% | 0.2 | 182 |

146 146 146 146

112 104/108 110/114

FIG. 9

78

148 150

Player ID: Player0625
Address: 1234 Main Street, Anytown
Postal Code: 10234
Postal ID: Inner 152 116 158 156 154

| | Session ID | Date | Start | End | Game Type | Total Wagered Amount |
|---|---|---|---|---|---|---|
| 80 | Session001 | 01/16/2016 | 20:32 | 22:05 | Slot | $232.00 |
| | Session002 | 02/18/2016 | 22:15 | 23:02 | Slot | $105.00 |
| | Session003 | 03/20/2016 | 20:05 | 21:32 | Table | $200.00 |
| 80 | Session004 | 05/14/2016 | 18:46 | 19:42 | Table | $230.00 |
| | Session005 | 05/24/2016 | 20:22 | 21:45 | Slot | $250.00 |

FIG. 10

90

Player ID: Player0625
Address: 1234 Main Street, Anytown
Postal Code: 10234
Postal ID: Inner

120

| | Patron Group | Card Level | Date Assigned | Comp Reinvestment | |
|---|---|---|---|---|---|
| | | | | Slot Reinvestment % | Table Game Reinvestment % |
| 92 | Inner R7 | Silver | 1/16/2016 | 6.0 | 20.0 |
| | Inner R5 | Silver | 7/22/2016 | 7.0 | 20.0 |
| | Inner R2 | Gold | 9/20/2016 | 15.0 | 20.0 |
| 92 | Inner R3 | Gold | 12/15/2016 | 12.5 | 20.0 |

FIG. 11

160

| Market ID (116) | Postal Code (152) |
|---|---|
| Inner (162) | 92101<br>92105<br>92108<br>92114 |
| Mid | 92109<br>92135<br>91950 |
| Feeder | 92139<br>92691<br>91101 |
| Outer | 89119<br>89002 |

FIG. 12

PLAYER TRACKING SYSTEM AND METHODS OF OPERATING SAME

CROSS-REFERENCE TO RELATED APPLICATION

This application claims benefit of U.S. Provisional Patent Application Ser. No. 62/450,432, filed on Jan. 25, 2017, which is hereby incorporated by reference in its entirety for all purposes.

FIELD OF THE INVENTION

The present invention relates generally to casino management systems, and more particularly, to a casino management system which tracks the gaming activities of patrons, stores data related thereto, and establishes a rating related to the relative worth of the patrons as a function thereof.

BACKGROUND OF THE INVENTION

The growth and competition in the casino gaming market in recent years and the increasingly sophisticated and complex technology being integrated into the gaming environment, presents both challenges and opportunities to gaming establishment operators. Over recent years, casino revenue has dramatically increased in the area of non-gaming revenue sources such as, hotel and hospitality, retail, dining, entertainment and other casino products or services. Traditionally, patron tracking systems have focused on tracking patrons of electronic gaming machines, table games and other gaming revenue areas such as, bingo and keno. In this traditional scenario, a patron is identified during gaming play by a patron tracking ID card and/or a patron identification number (PIN). The patron tracking system tracks the patron's gaming play and may award patron tracking points, bonuses, and other incentives according to established criteria to promote continued patron loyalty.

In most cases, the patron tracking points earned by play electronic gaming machines, table games and other gaming revenue areas such as, bingo and keno may be redeemed for prizes, such as complimentary meals, merchandise, hotel and services through non-gaming revenue point-of-sales devices linked to the patron tracking system. In these cases, non-gaming casino revenue patron tracking has been limited to the redemption of points and prizes earned by tracking the patron's play at gaming revenue sources. U.S. Pat. No. 5,655,961 teaches a method whereby patron tracking points are redeemed at a redemption counter in the casino for meals or clothing. The patron tracking points, therefore, are an additional inducement to encourage gaming revenue source play. U.S. Pat. No. 7,303,475 further extends this method whereby patrons can redeem their patron tracking points for non-gaming revenue products and services and can earn patron tracking point based on products or services purchases at remote redemption centers.

As non-gaming revenue increases, methods are needed to track and record the patron's purchases (spend). Furthermore, methods are needed to establish the profitability of patron's purchases and to rank and score the patron's net worth in the area of non-gaming revenue purchases. Moreover, there is an emerging category of casino patrons who are not members of the traditional casino patron club of electronic gaming machines, tables games or other gaming revenue sources, yet spend large amount of money in non-gaming revenue areas. Traditional patron tracking systems do not track, rate or score this category of patron.

Some casinos utilize an entirely separate system which may be used to store, independently, both player tracking data and other information related to the casino resort patron. The other information may be relate to the patron's transactions or visit, or originate at, the hotel, restaurant(s), retail outlet(s), spa(s), etc. . . . . There are several problems with this approach. First, a completely different and additional system is used to receive the player tracking data (from the casino management system or CMS) and the other data and to store it. Secondly, such external systems must be tailored specifically to work with the CMS and other systems, such that the data from these systems is understood. In other words, the data from these systems is typically maintained in different formats and must be translated in order to be understood and stored. This is a very laborious and expensive undertaking. Furthermore, it is also difficult and expensive to maintain. For instance, if one of the underlying system changes, then the additional external system may also require corresponding updates.

The present invention is aimed at one or more of the problem as set forth above.

SUMMARY OF THE INVENTION

In different embodiments of the present invention, systems and methods for operating a casino management networked computer system including a player tracking system, are provided.

In one embodiment of the present invention, non-transitory computer-readable storage media, having computer-executable instructions embodied thereon, is provided. When executed by a processor, the computer-executable instructions cause the processor to generate and store a program file including a patron logic matrix arranged in a spreadsheet in a computer memory device. The patron logic matrix includes a plurality of rows and a plurality of columns intersecting the plurality of rows to define a plurality of logic cells. The plurality of rows includes data associated with patron ranking criteria. Each row corresponds to a data record of patron ranking information included in the spreadsheet. Each column includes a unique object identifier. Each logic cell includes a ranking criteria data value. Each data record of patron ranking information includes a column including a market definition value associated with a plurality of postal codes, a column including a patron ranking value, a column including a theoretical loss value associated with the patron ranking value, and a column including comp reinvestment data. The patron logic matrix includes a plurality of data record sets, each data record of patron ranking information included in a corresponding data record set including an identical market definition value and a different patron ranking value. The processor generates and stores a plurality of patron data records in the computer memory device. Each patron data record includes a unique patron ID, patron address information including a postal code, and patron wagering data. The processor receives a request to generate a patron comp point value from a gaming device including a patron ID, accesses the plurality of patron data records and retrieves a patron data record having a unique patron ID matching the received patron ID. The processor determines a patron theoretical loss value based on patron wagering data included in the retrieved patron data record, accesses the patron logic matrix and identifies the data record set associated with the market definition value associated with a postal code included in the retrieved patron data record, and selects a data record of patron ranking information included in the identified data record set having a theoretical loss value associated with the determined patron theoretical loss value. The processor calculates a patron comp point value based on comp reinvestment data included in the selected data record of patron ranking information and the patron wager data included in the retrieved patron data record, and generates and displays patron information including the calculated patron comp point value on a display device associated with the gaming device.

In another embodiment, a casino management networked computer system is provided. The networked computer system includes a database server computer including a database server processor coupled to a database memory device, and an application server computer coupled to the database server computer and to a plurality of gaming devices that includes an application processor. The database server processor is programmed to generate and store a program file including a patron logic matrix arranged in a spreadsheet in the database memory device. The patron logic matrix includes a plurality of rows including data associated with patron ranking criteria and a plurality of columns intersecting the plurality of rows to define a plurality of logic cells. Each row corresponds to a data record of patron ranking information included in the spreadsheet. Each column includes a unique object identifier. Each logic cell includes a ranking criteria data value. Each data record of patron ranking information includes a column including a market definition value associated with a plurality of postal codes, a column including a patron ranking value, a column including a theoretical loss value associated with the patron ranking value, and a column including comp reinvestment data. The patron logic matrix includes a plurality of data record sets. Each data record of patron ranking information included in a corresponding data record set includes an identical market definition value and a different patron ranking value. The database server processor generates and stores a plurality of patron data records in the database memory device. Each patron data record including a unique patron ID, patron address information including a postal code, and patron wagering data. The application processor is programmed to receive a request to generate a patron comp point value from a gaming device including a patron ID, and access the plurality of patron data records and retrieve a patron data record having a unique patron ID matching the received patron ID. The application processor determines a patron theoretical loss value based on patron wagering data included in the retrieved patron data record, accesses the patron logic matrix and identify the data record set associated with the market definition value associated with a postal code included in the retrieved patron data record, and selects a data record of patron ranking information included in the identified data record set having a theoretical loss value associated with the determined patron theoretical loss value. The application processor calculates a patron comp point value based on comp reinvestment data included in the selected data record of patron ranking information and the patron wager data included in the retrieved patron data record, and generates and displays patron information including the calculated patron comp point value on a display device associated with the gaming device.

In yet another embodiment, a server computer for use in a casino management networked computer system is provided. The server computer includes a database and a processor coupled to the database. The processor is programmed to generate and store a program file including a patron logic matrix arranged in a spreadsheet in the database. The patron logic matrix includes a plurality of rows including data associated with patron ranking criteria, and a plurality of columns intersecting the plurality of rows to define a plurality of logic cells. Each row corresponds to a data record of patron ranking information included in the spreadsheet. Each column includes a unique object identifier. Each logic cell including a ranking criteria data value. The patron logic matrix includes a first column including market definition values associated with a plurality of postal codes, a second column including patron ranking values, a third column including average daily theoretical loss values associated with a corresponding patron ranking value, a fourth column including total theoretical loss values associated with a corresponding patron ranking value, a fifth column including ranking evaluation period values for determining a patron theoretical loss value, a sixth column including slot comp reinvestment percentage values for calculating a patron comp point value based on total wagered amounts associated with slot games, a seventh column including table game comp reinvestment percentage values for calculating the patron comp point value based on total wagered amounts associated with table games, and an eighth column including comp reinvestment evaluation period values for determining total wagered amounts associated with slot games and total wagered amounts associated with table games for calculating the patron comp point value. The patron logic matrix includes a plurality of data record sets, each data record of patron ranking information included in a corresponding data record set including an identical market definition value and a different patron ranking value.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 9-12 are illustrations of exemplary database records generated by the system shown in FIGS. 1, 5, and 6, according to embodiments of the present invention.

Corresponding reference characters indicate corresponding parts throughout the drawings.

DETAILED DESCRIPTION OF INVENTION

Figure 1:
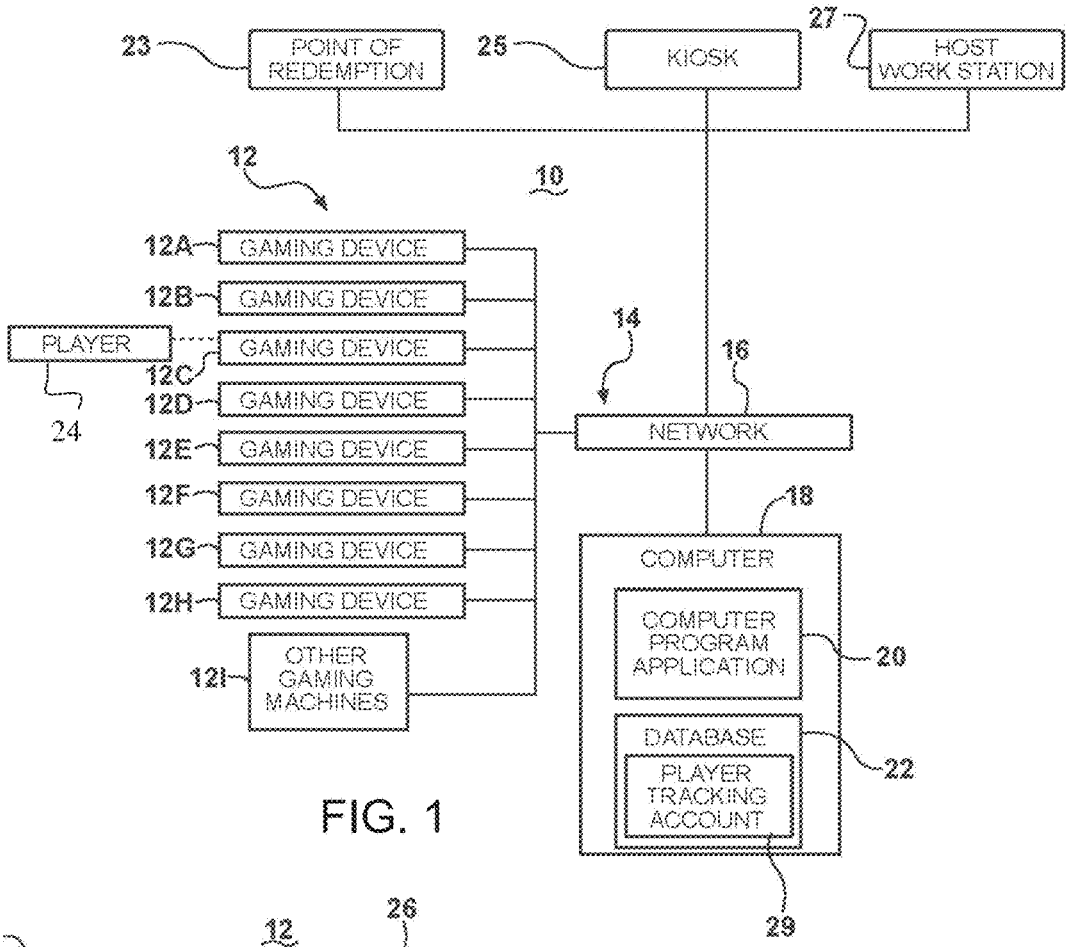
FIG. 1 is schematic diagram of a networked computer system for tracking gaming and non-gaming activities of a patron at a resort, according to an embodiment of the present invention.

With reference to the drawings, and in operation, the present invention overcomes at least some of the disadvantages of known systems by providing a system that is configured to determine a player comp award provided to the player based on theoretical loss value associated with the total amount of wagers being placed by the player during an evaluation period. In addition, the system is configured to determine patron ranking assignments based on Market (postal code groupings) and provide an evaluation of Average Daily Theoretical loss (ADT) or Total Theoretical loss value within a given period. These rankings are then used by the system to determine a comp point reinvestment percentage of theoretical. In addition, the system is configured to query on historical ranking changes using patron identifies (PTNID), Days Highest Rank, and/or Date of Rank change.

In addition, the system is configured to track patron events at a plurality of devices including gaming machines, point-of-sale (POS) terminals, gaming tables, and/or sports book terminals. The system is configured to receive information related to the player(s)' and/or patron(s)' use of the devices and establish a player rating based thereon. The player rating may be a single number which reflects a value reflective of the player or patron's relative "worth" to a casino or resort.

In one embodiment, the system is configured to generate a player ranking matrix (shown in FIG. 9) for use in establishing a player ranking based on player postal codes. The player ranking may then be used by the system to determine player comp values that are used to provide awards to players such as bonus points that may be used for purchase and/or wagering activities within a casino.

For example, in one embodiment, the system may be configured to perform the following operations:

1). The system 10 may be configured to access a patron record and establish a Market definition that is defined in the Synkros database to align patron postal codes with a Market ID associated with the player ranking matrix. In addition, a default Market ID may also be assigned if the patron does not have an addressed listed in a patron record.

2.) The system 10 may also generate the player ranking matrix and store the player ranking matrix in a Synkros database to provide ranking criteria definitions based on: a. Market, b. ADT or Total Theo ranges; and c. Days evaluated.

3) The system may also be configured to initiate a nightly process to calculate "all" active patrons and place them into a "Rankin" with their current ADT and Total Theo based on the Days Evaluated parameter (minus 1).

4.) The system may also initiate a process that runs every few minutes to evaluate the current "Ranking" based on the previous nightly process data, "plus" any additional rating info collected since the last nightly process. This process will provide a Ranking update based on the "ADT or Total Theo" and "Days Evaluated" criteria. The "target interval" will be approximately every 15 minutes or less, based on process optimization.

5.) The system may also generate patron rankings based on Dynamic Patron Group assignments. The initial automated process will create the groups with a naming convention of "Market name" concatenated with the "Ranking designator", (i.e., "Inner-R1", "Inner-R2", etc.).

6.) The system may generate Dynamic Patron Groups to be available for other incentives and ad-hoc reporting.

7.) The system may also generate Incentives to assign the appropriate comp point multipliers based on the Ranking (Group Assignment). The Groups tab on the Incentive setup form will be used to associate the Groups with the Incentive.

8.) The system may also be configured to evaluate each new rating or rating update to determine what incentives are applicable. Since the Rankings will be adjusted every few minutes, "as well as on each rating update or close", it will allow for the incentive to award the point multiplier for the entire rating to be based on the appropriate ranking.

9.) The system will also generate a view for Postal Code/Address History that is provided in the Data Access Layer (DAL) to provide the necessary fields to join with other existing views to allow for the system to query for the Ranking Change History.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

Figure 5:
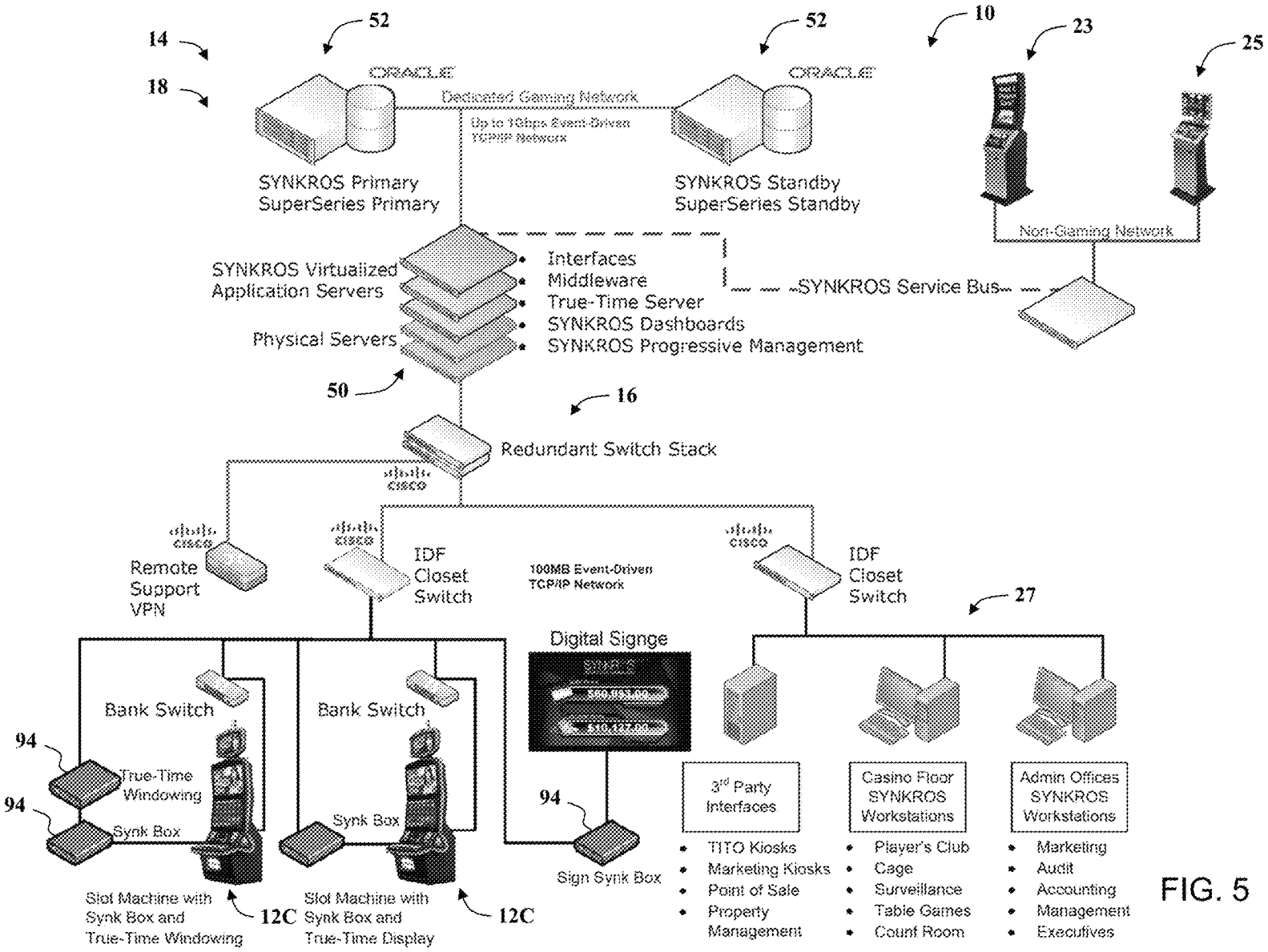
FIG. 5 is another schematic of the networked computer system shown in FIG. 1, according to an embodiment of the present invention.

Referring to FIGS. 1 and 5, in the illustrate embodiment, the system 10 includes a plurality of devices 12 that are coupled to an entertaining management and monitoring system 14 with a communications network 16. The entertaining management and monitoring system 14 includes a server computer system 18 that is coupled to the plurality of devices 12 for use in tracking patron events at each of the devices 12. In one aspect of the present invention the devices 12 may be gaming machines 12A-12H, 12I or non-gaming machines 12J, 12K, 12L, such as, for example, point-of-sale (POS) terminals, gaming tables, and/or sports book terminals.

For example, in one embodiment, a non-gaming machine may include a user computing device that is configured to transmit and receive data to and/or from the server computer system 18 to display graphical interfaces to enable a user to interact with an operate the system 10 with the user computing device. In the illustrated embodiment, the server computer system 18 is coupled to each user computing device via the communications network 16 that enables each user computing device to access the server computer system 18 over the network 16 such as, for example, the Internet, a cellular telecommunications network, a wireless network and/or any suitable telecommunication network. For example, in one embodiment, the user computing device may include a mobile computing device, e.g., a smartphone that communicates with the server computer system 18 via the cellular telecommunications network and/or the Internet. In another embodiment, the user computing device may include a personal computer, laptop, cell phone, tablet computer, smartphone/tablet computer hybrid, personal data assistant, and/or any suitable computing device that enables a user to connect to the server computer system 18.

In one aspect of the present invention, the system 10 and method receive information related to the player(s)' and/or patron(s)' use of the devices 12 and establish a player rating based thereon. The player rating may be a single number which reflects a value reflective of the player or patron's relative "worth" to a casino or resort. In one aspect of the present invention, the patron's relative worth may be first established with respect to a plurality of predetermined criteria. For example, in one embodiment, the predetermined criteria include recency, i.e., how recent has the player or patron used a device 12 or visited the casino or resort, frequency (of visits), monetary value, and profit margin (see below).

In one embodiment, the server computer system 18 is configured to generate data regarding the patrons' use of the devices 12 (gaming and non-gaming) and, for a given time period, each patron is scored relative to all other patrons for each criteria. The scores, for example, may be established as percentiles. For example, assuming that there are 100 patrons, if one of the patrons frequented the resort more than all other patrons during the past month, that patron would be in the $99^{th}$ percentile.

For each patron, their percentile score is established for each criterion. The percentile scores are then combined to establish a single value using a predetermined weighting scheme. For example, the single value may be established using:

$$(A*R)+(B*F)+(C*M)+(D*P),$$

where A, B, C, & D are first, second, third and fourth weighting factors and R, F, M & P are the patron's percentile scores for recency, frequency, monetary value, and profit margin.

Generally, the weighting factors are set by the casino and may be changed. Sample weighting factors are 15%, 15%, 30%, and 40%, respectively.

The single value may be established for different time periods. For example, in one embodiment, the single value may be established for the last month, the last three months, the last 12 months, and lifetime. The single values may be combined, for example, by averaging, to establish a total value.

Any of the single values or the total value may be utilized by the casino for a myriad of purposes (see below).

In one embodiment, the system 10 and method may be embodied or implemented via an entertaining management and monitoring system 14 which is shown in block diagram form in FIG. 1. The entertainment and monitoring system 14 may include additional functions such as, real-time multi-site, slot accounting, player tracking, cage credit and vault, sports book data collection, Point of Sale (POS) accounting, keno accounting, bingo accounting, and table game accounting, a wide area progressive jackpot, and electronic funds transfer (EFT).

As shown, the system 10 includes a plurality of devices 12. Devices 12 may include, but are not limited to gaming machines, electronic gaming machines (such as video slot, video poker machines, or video arcade games), electric gaming machines, virtual gaming machines, e.g., for online gaming, an interface to a table management host workstation 27 for table games, kiosks 25, point of sale or redemption terminals 23, or other suitable devices at which a patron may interact or access a user or player account. In the illustrated embodiment, eight electronic gaming devices or machines (EGM) 12A-12H are shown. However, it should be noted that the present invention is not limited to any number or type of machines 12. In one embodiment, the machines 12 are organized into banks (not shown), each bank containing a plurality of machines 12.

Other types of gaming machines which may be included (see above) are indicated with reference number 12I. The devices 12 are connected via a network 16 to one or more host computers or servers 18, which are generally located at a remote or central location. The server computer system 18 includes a computer program application 20 which maintains one or more databases 22. In one embodiment, the database(s) are Oracle database(s).

The computer program application 20 and databases 22 may be used to record, track, and report accounting information regarding the gaming machines 12 and players of the gaming machines 12. Additionally, the computer program application 20 and database(s) 22 may be used to maintain information related to player or player tracking accounts (see below).

In general, the machines 12 may be used by a user or player, i.e., to access their player account. For example, a gaming machine 12C is playable by a player 24. The player 24 may select one of the gaming machines 12C to play and insert a coin, credit, coupon, and/or player tracking card (not shown) into the chosen EGM 12C. Generally, the gaming machines 12C have an associated number of credits or coins required in order to play. In the case of video slot or poker games, the game is played and an award in the form of credits may be awarded based on a pay table of the gaming machine 12.

Figure 2:
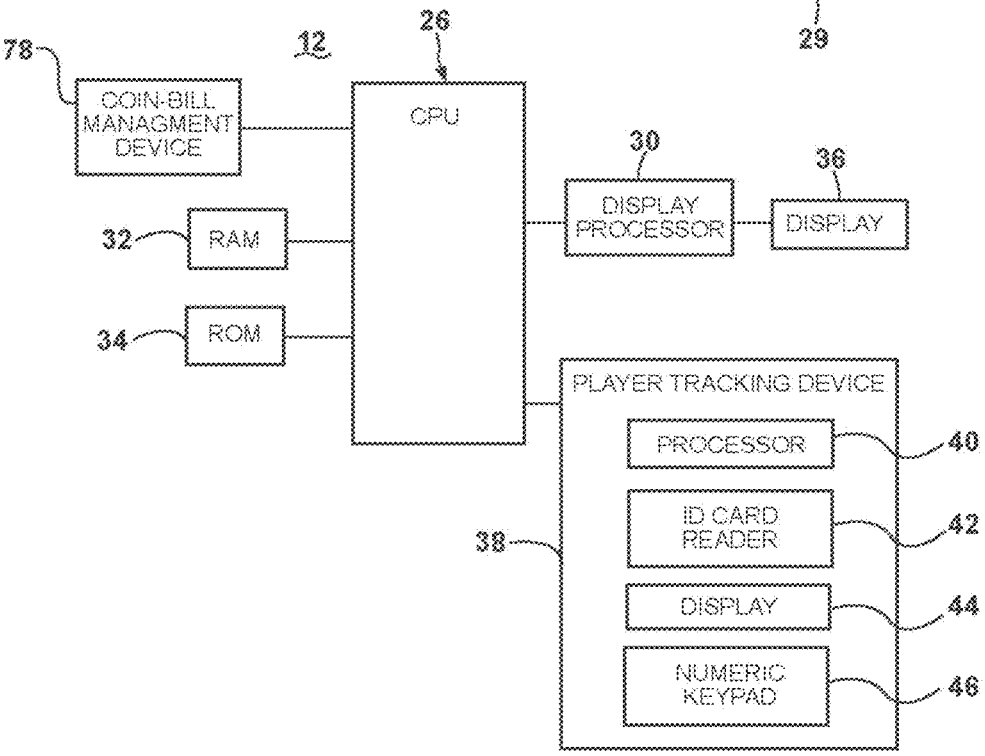
FIG. 2 is a schematic diagram of a gaming machine for use with the system shown in FIG. 1, according to an embodiment of the present invention.
Figure 3:
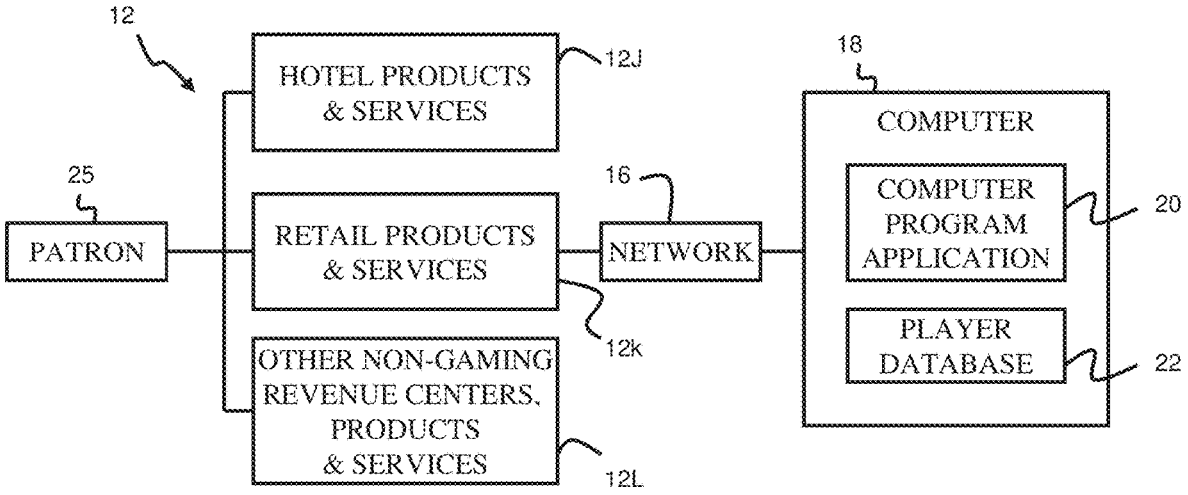
FIG. 3 is another schematic diagram of the system shown in FIG. 1, according to an embodiment of the present invention.
Figure 6:
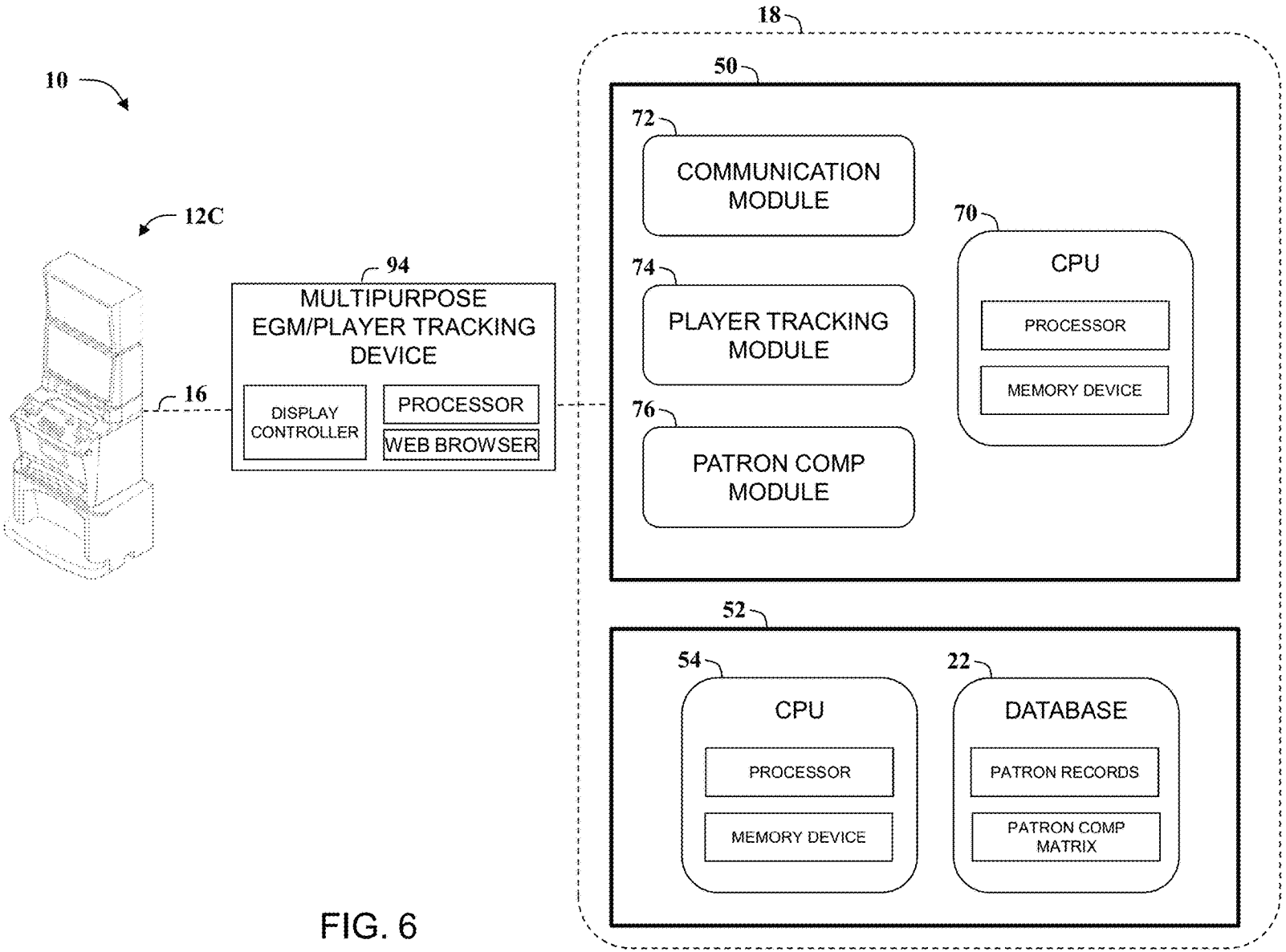
FIG. 6 is another schematic diagram of the system the system shown in shown in FIGS. 1 and 5 including a server computer and a gaming machine, according to an embodiment of the present invention.

FIG. 2 is a block diagram of a suitable electronic gaming machine 12C. FIG. 6 is a schematic view of the gaming machine 12C. In one embodiment, the gaming machine 12C may be a video gaming machine preferably installed in a casino. The machine 12C comprises a game controller 26, or central processing unit (CPU), a coin-bill management device 28, a display processor 30, a RAM 32 as a memory device and a ROM 34 (generally provided as an EPROM). The CPU 26 is mainly composed of a microprocessor unit and performs various calculations and motion control necessary for the progress of the game. The coin-bill management device 28 detects the insertion of a coin or a bill and performs a necessary process for managing the coin and the bill. The display processor 30 interprets commands issued from the CPU 26 and displays desirable images on a display 36. The RAM 32 temporarily stores programs and data necessary for the progress of the game, and the ROM 34 stores, in advance, programs and data for controlling basic operation of the machine 12C, such as the booting operation thereof, game code and graphics.

Figure 7:
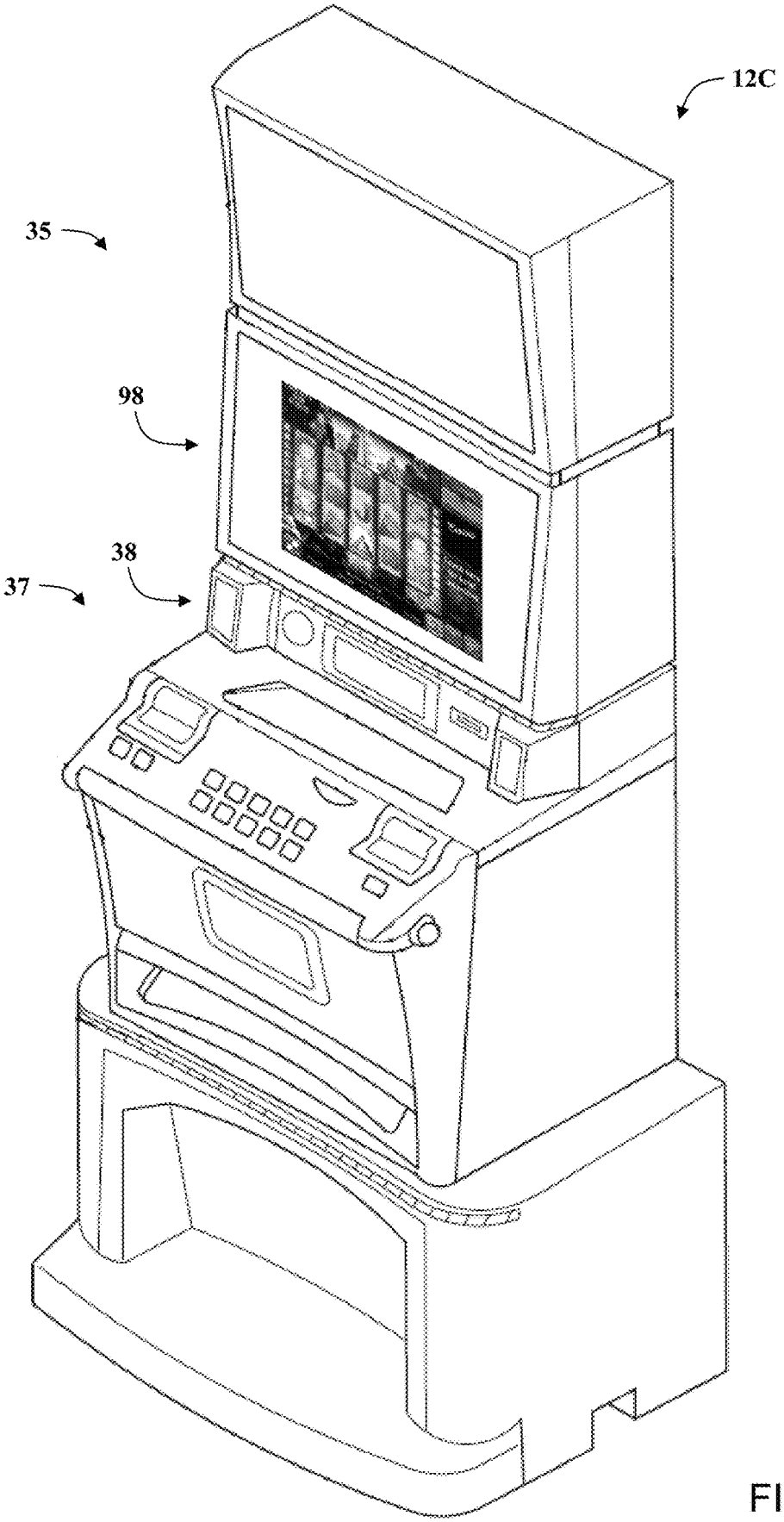
FIG. 7 is a schematic of a gaming machine that may be used with the system shown in FIGS. 1, 5, and 6, according to an embodiment of the present invention.

With reference to FIG. 7, in one embodiment, the gaming machine 12C may be a video gaming machine preferably installed in a casino. In the illustrated embodiment, the gaming machine includes a gaming display 35 for displaying a plurality of games, a user input device 37 to enable a player to interface with the gaming machine, and a gaming controller 26 that is operatively coupled to the gaming display 35 and the user input device 37 to enable a player to play games displayed on the gaming display. The gaming machine also includes a cabinet assembly that is configured to support the gaming display, the user input device, and/or the gaming controller from a gaming stand and/or a supporting surface.

The gaming display 35 and the user input device 37 are coupled to the cabinet assembly and are accessible by the player. In one embodiment, the gaming controller 26 is positioned within the cabinet assembly. Alternatively, the gaming controller may be separated from the cabinet assembly, and connected to components of the gaming machine through a network such as, for example, a local area network (LAN), a wide area network (WAN), dial-in-connections, cable modems, wireless modems, and/or special high-speed Integrated Services Digital Network (ISDN) lines.

In one embodiment, the user input device 37 includes a plurality of input buttons, a coin slot, and/or a bill acceptor. The coin slot includes an opening that is configured to receive coins and/or tokens deposited by the player into the gaming machine. The gaming machine converts a value of the coins and/or tokens to a corresponding amount of gaming credits to establish a credit balance that are used by the player to wager on games played on the gaming machine.

The bill acceptor includes an input and output device that is configured to accept a bill, a ticket, and/or a cash card into the bill acceptor to enable an amount of gaming credits associated with a monetary value of the bills, ticket, and/or cash card to be credited to the gaming machine. Moreover, the gaming machine may also utilize a cashless wagering system (not shown), such as a ticket in ticket out (TITO) system (not shown). In one embodiment, the bill acceptor also includes a printer (not shown) that is configured to dispense a printed voucher ticket that includes information indicative of an amount of credits and/or money paid out to the player by the gaming machine during a gaming session. The voucher ticket may be used at other gaming machines, or redeemed for cash, and/or other items as part of a casino cashless system (not shown).

A coin tray is coupled to the cabinet assembly and is configured to receive a plurality of coins that are dispensed from the gaming machine. One or more speakers are installed inside the cabinet assembly to generate voice announcements and/or sound effects associated with game play. The gaming machine also includes one or more lighting devices that are configured to blink and/or change brightness and color in specific patterns to produce lighting effects to enhance a visual gaming experience for the player.

In one embodiment, the input buttons include a plurality of BET switches for inputting a wager on a game, a plurality of selection switches for selecting a betting line and/or card, a MAXBET switch for inputting a maximum wager, a PAYOUT switch for ending a gaming session and dispensing accumulated gaming credits to the player, and a start switch, i.e., a SPIN/DEAL button to initiate an output of a game.

In the illustrated embodiment, the BET switches include five switches from 1BET to 5BET to enable a player to wager between a minimum bet up to 5× minimum bet. Each selection switch corresponds to a betting line such as, for example, a payline and/or symbol for a reel game, one or more cards for a card game, and/or a symbol for a roulette game, to enable a player to associate a wager with one or more betting lines. The MAXBET switch enables a player to input the maximum bet that a player can spend against one play of a game. The PAYOUT switch enables a player to receive the amount of money and/or credits awarded to the player during a gaming session, which has been credited onto the gaming machine. Input to the gaming device 12C may be accomplished via mechanical switches or buttons or via a touchscreen interface. Such gaming machines 12 are well known in the art and are therefore not further discussed.

The player 24 and/or patron 24 is identified via the player tracking card and/or a player identification number entered into player tracking device 38 at each EGM 12 (see below). Player tracking accounts may be used, generally, to provide bonuses to a player, in addition to the award designated by, in the case of a video slot or poker machine, the EGM's 12 paytable. These bonuses may be awarded to the player 24 based a set of criteria, including, but not limited to, a) the player's play on the machine 12C, b) the player's overall play, c) play during a predetermined period of time, and d) the player's birthday or anniversary, or e) any other definable criteria. Additionally, bonuses may be awarded on a random basis, i.e., to a randomly chosen player or randomly chosen game 12. Bonuses may also be awarded in a discretionary manner or based on other criteria, such as, purchases made at a gift shop or other affiliated location.

In one embodiment, the player tracking device 38 includes a processor 40, a player identification card reader 42 and/or a numeric keypad 44, and a display 46. In one embodiment, the display 46 is a touchscreen panel and the numeric keypad 44 is implemented thereon.

The player 24 may be identified by entry of a player tracking card into the player identification card reader 42 and/or entry of a player identification number (PIN) on the numeric key pad 46. The play tracking device 38 may also be used to communicate information between the server computer system 18 and the corresponding EGM 12C. The player tracking device 40 may also be used to track bonus points, i.e., incentive points or credits, downloaded from the server computer system 18.

Each device 12 has a value associated therewith. With respect to the gaming machines 12A-12I, the value is a theoretical hold percentage. The theoretical hold percentage may be defined as the casino or establishment's estimated, average revenue percentage. For example, if the gaming machine 12 is a slot machine, the hold percentage is the expect house's estimate, average take or revenue for a particular machine. For a non-gaming device 12, e.g., a point of sale terminal, such as a cash register, a restaurant, or a spa, the theoretical hold percentage may be set to an estimated profit percentage for the given device 12.

In one aspect of the present invention, each player tracking device 38 is associated with one of the electronic gaming machines 12A-12I. The player tracking devices 38 identify patrons interacting with the system 12, for track wagers made by the players on the electronic gaming machines 12A-12I and record wager data associated with each wager made by the player and a respective electronic gaming machine 12A-12I. In one embodiment, the wager data includes a device type associated with respective gaming machine, an electronic gaming machine identifier, the theoretical hold percentage associated with the respective gaming machine, and an amount of the respective wager. The wager data may also include a player ID and a date/time stamp.

The server computer system 18 is in communication with the player tracking devices 38 and the non-gaming machines 12J, 12K, 12L for receiving the wager data associated with the patrons and the respective gaming machine 12A-12I from the player tracking device 38 and storing the wager data in a database and, for receiving transaction data associated with a transaction associated with the patrons' use of the non-gaming devices 12J, 12K, 12L and storing the transaction data in the database. The computer also establishes a player rating associated with each player as a function of the wager data and the transaction data.

In one embodiment of the present invention, the transaction data includes a device type of the non-gaming machine 12J, 12K, 12L, an identifier of the non-gaming machine, and the estimated profit of the non-gaming machine. The transaction data may also include a patron ID and a date/time stamp.

In one embodiment, the wager data and the transaction data are stored in a table in the database. In another embodiment, the wager data is stored in a first table in the database and the transaction data is stored in a second table in the database.

In one embodiment, the server computer system 18, in establishing the player rating, performs the following steps:

(a) establishes a first percentile ranking for each patron relative to the other patrons as a function of the wager and transaction data for a first predetermined time period in each of a plurality of criteria, (b) establishes a first valuation number as a function of the percentile rankings in each of the plurality of criteria and a plurality of predetermined weighting factors, (c) establishes a second percentile ranking for each patron relative to the other patrons as a function of the wager and transaction data for a second predetermined time period in each of the plurality of criteria, and (d) establishes a second valuation number as a function of the percentile rankings in each of the plurality of criteria and the plurality of predetermined weighting factors.

As discussed above, the server computer system 18 may combine the first and second valuation numbers into an overall valuation number. Furthermore, the system 10 may establish additional valuation numbers for different time periods, for example, the previous month, the previous three months, the previous year, and lifetime, i.e., all available data.

In one embodiment, the criteria includes recency, frequency, monetary value, and profit margin. Recency refers to the most recent or last visit to the resort by the player as determined by the last use of one of the devices 12. Frequency refers to the number of visits or uses by the player or patron's use of the devices. The monetary value is the amount spent and wagered by the player/patron during the time period. The profit margin is a value determined by multiplying the amount wagered or spent multiplied by the theoretical win or the estimate profit percentage of the gaming machine 12A-12I or non-gaming machine 12J, 12K, 12L. This determined for each wager and transaction and then added together.

In one embodiment, the wager data and the transaction data are stored in a single table in the database or in separate tables. However in one embodiment, even if the data is stored in two different tables, the fields of the table are the same. It should be noted that each wager and each transaction is stored as a separate record.

Referring to FIGS. 5 and 6, in one embodiment, the server computer system 18 may include one or more middleware application server computers 50 and one or more database server computers 52. The database server computer 52 includes a database server processor 54 that is coupled to a database memory device that includes the database 22. The database server processor 54 is programmed to retrieve and store information contained in the database 22. The database 22 contains information on a variety of matters, such as, for example, web pages associated with one or more websites, patron account information, patron wagering information, patron ranking information, postal code information, patron comp point value information, patron purchasing information, and/or any suitable information that enables the system 10 to function as described herein.

The middleware application server computer 50 includes a central processing unit (CPU) including an application processor 70 that is programmed to communicate with each of the gaming devices 12 and the database server computer 52. In the illustrated embodiment, the application processor 70 includes a communication module 72, a player tracking module 74, and a patron comp module 76. The application processor 70 includes one or more processors that are coupled to a memory device. In addition, the application processor 70 executes various programs, and thereby controls components of the server computer system 18 according to user instructions received from one or more devices 12 and/or the player tracking device 38 to enable users to interact with an operate the server computer system 18. For example, in the illustrated embodiment, the application processor 70 is programmed to receive player tracking data from one or more player tracking devices 38 and generate player tracking account records to monitor the amount of wagers and/or product purchase being made by the player.

The communication module 72 is programmed to communicate with the system devices 12 and/or player tracking devices 38 to facilitate transmitting data over the network 16. The communication module 72 is also programmed to access and retrieve information being stored in the database 22 and transmit and store information being received from the application processor 70 in the database 22.

In one embodiment, the communication module 72 includes a web-browser program that generates and transmits software code including, but not limited to HTML, JavaScript, and/or any suitable programming code that enables the gaming machine 12C, table management host workstation 27 for table games, kiosks 25, point of sale or redemption terminals 23, and/or other gaming devices and/or non-gaming devices to display a website and/or webpages. The communication module 72 may be programmed to host a website including webpages that are accessible by a user via one or more gaming devices and/or non-gaming devices. The communication module 72 executes a website application program that retrieves code from the database 22 and executes the application code to render one or more webpages on a display device of a gaming devices and/or non-gaming devices in response to requests received from the user via the gaming devices and/or non-gaming devices to allow users to interact with the website.

The player tracking module 74 is configured to receive player tracking information from one or more player tracking devices 38 and generate player tracking accounts for use in storing the information received from the player tracking devices 38. For example, in one embodiment, the player tracking module 74 is configured to generate and store a plurality of player account records 78 (shown in FIG. 10). Each player account record 78 includes a unique player ID associated with a casino patron, address information associated with the casino patron including a corresponding postal code. Each player account records 78 also includes player tracking data that includes information on the amount of wagers and type of games being played by the patron and/or an amount of goods and/or services being purchase by the patron. For example, as show in FIG. 10, each player account record 78 may include one or more patron transaction records 80. Each patron transaction record 80 is associated with a transaction being made by the corresponding patron. Each patron transaction record 80 may include information that indicates a transaction being made by the patron such as, for example, a purchase being made at a POS terminal associated with the casino, an amount of wagers being placed with a slot machine, and/or an amount of wagers being placed at a table game.

For example, in one embodiment, during operation, the patron may enter player information at a player tracking device 38 associated with a gaming machine 12 to initiate a gaming session to begin placing wagers on the games being provided by the gaming machine 12. The patron may enter player information by inserting a player card in to the player tracking device 38 and/or entering a unique player ID such as, for example, a username and password, or personal identification number (PIN). In another embodiment, the player may initiate a gaming session at a gaming table, and allow a casino employee enter player information into a player tracking device 38 and/or user computing device associated with the gaming table.

Upon receiving the player information, the player tracking module 74 may access the database 22 to identify and retrieve a player tracking account record 78 associated with the player information including the unique player ID. The player tracking module 74 may then generate a patron transaction record 80 including information associated with the gaming session including, but not limited to, a unique session ID, a date of the gaming session, a start time, and a game type. Upon completion of the gaming session, the player tracking device 38 and/or player tracking module 74 receives information associated with amount of wagers being placed by the player during the gaming session and updates the patron transaction record 80 to include an end time to the gaming session, and a total amount of wagers being placed.

The patron comp module 76 is configured to determine an amount of patron comp awards that may be provided to a patron by the casino based on an amount of wagers being placed and/or an amount of purchase being made by the patron over a predefined evaluation period. Patron comp awards may include, but are not limited to, bonus points, gaming credits, incentive points, and/or any suitable award that may be provided to the patron. For example, in one embodiment, bonus awards may be provided to a player and stored in a corresponding player account for use by the player to purchase goods and/or services offered by the gaming property and/or for placing wagers on games being played on the gaming machine. In one embodiment, bonus awards include bonus points that may include incentive points. Incentive points may be exchanged for game play, gifts and/or property services, such as hats, t-shirts, meals, shows, and/or property amenities such as spa/pool services, nightclub services, etc.

In another embodiment, the bonus points may also be convertible to gaming credits, which may be designated as cashable or non-cashable. Cashable credits, or incentive points converted into credits, may be downloaded to a gaming machine. When the player has finished playing the gaming machine, any remaining credits may be cashed out, i.e., retrieved as coins or placed on a printed ticket or player tracking card for redemption or play on another gaming machine. In addition, cashable credits may be used to purchase goods and/or services provided by the casino gaming property and/or 3$^{rd}$ party vendors.

Non-cashable credits must be used for game play and/or wagering on games being played with the gaming machine. When the player stops playing a gaming machine, any remaining non-cashable credits which were downloaded to the gaming machine are either lost or uploaded back to the player account.

In the illustrated embodiment, the patron comp module 76 is configured to generate and store a patron ranking logic matrix 82 (shown in FIG. 9) in the database 22, and use the patron ranking logic matrix 82 to establish a player ranking associated with the patron that may be used to determine a comp award value being provided to the patron. As shown in FIG. 9, in the illustrated embodiment, the patron ranking logic matrix 82 includes a plurality of patron ranking data 84, ranking calculation data 86, and comping reinvestment data 88. The patron ranking data 84 include the following information: Markets including Grouping of Patron's Postal Codes to identify marketing area, and a Patron ranking value. The ranking calculation data 86 includes the subdivided categories determined by the ADT or Total Theo for a given evaluation period including: ADT Criteria including Average Daily Theoretical loss for a given evaluation period; Total Theo including Total theoretical loss; and Ranking Days Evaluated including a number of days prior to the evaluation day, up to the evaluation day (current). The comping reinvestment data 88 includes: Slot Reinvest % including Percentage of Slot Theoretical Loss that will be awarded as a multiplier (per ranking); Tables Reinvest % including Percentage of Tables Theoretical Loss that will be awarded as a multiplier (per ranking); and Comp Days Evaluated including the number of Days prior to the evaluation day, up to the evaluation day (current).

Figure 20:
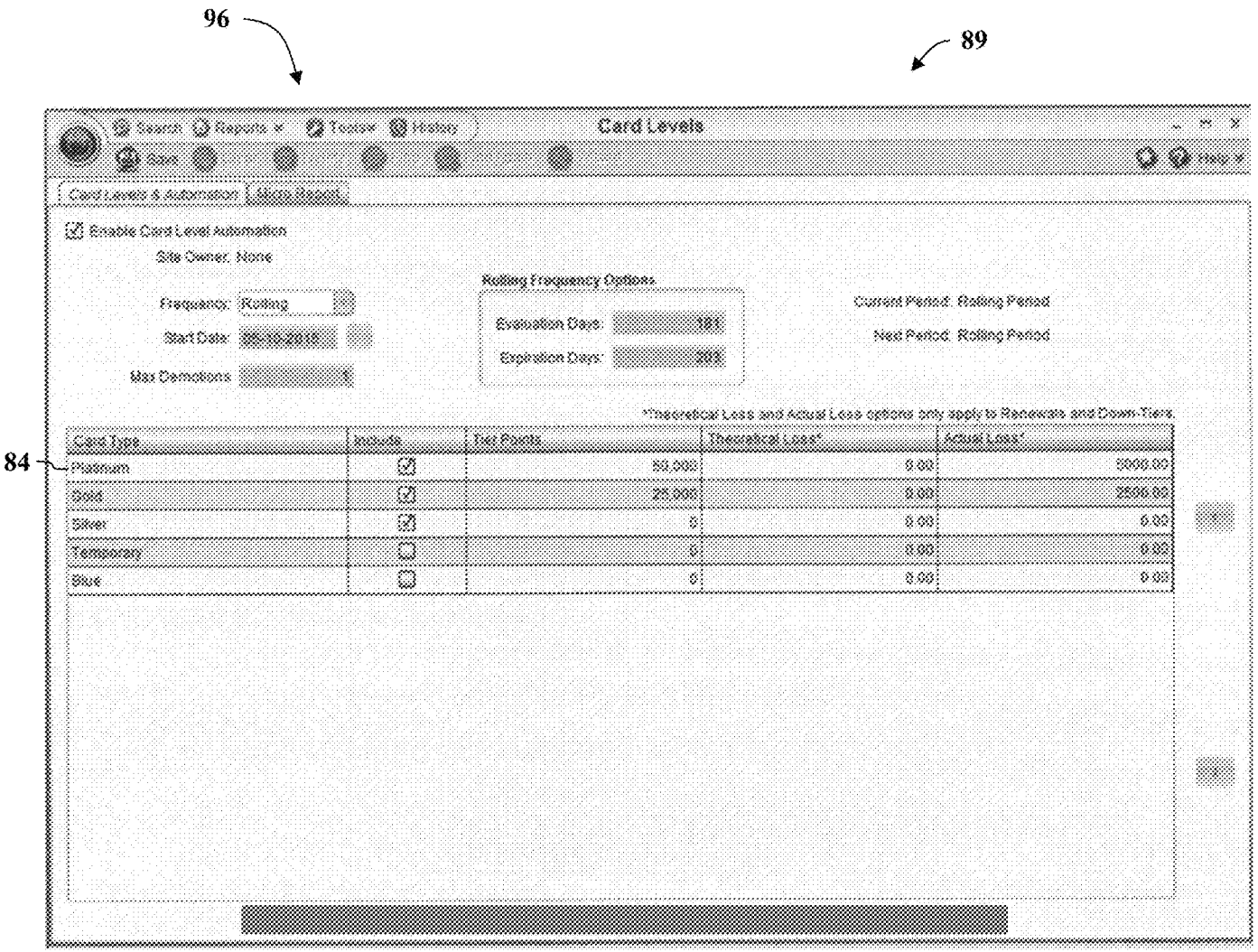
Figure 21:
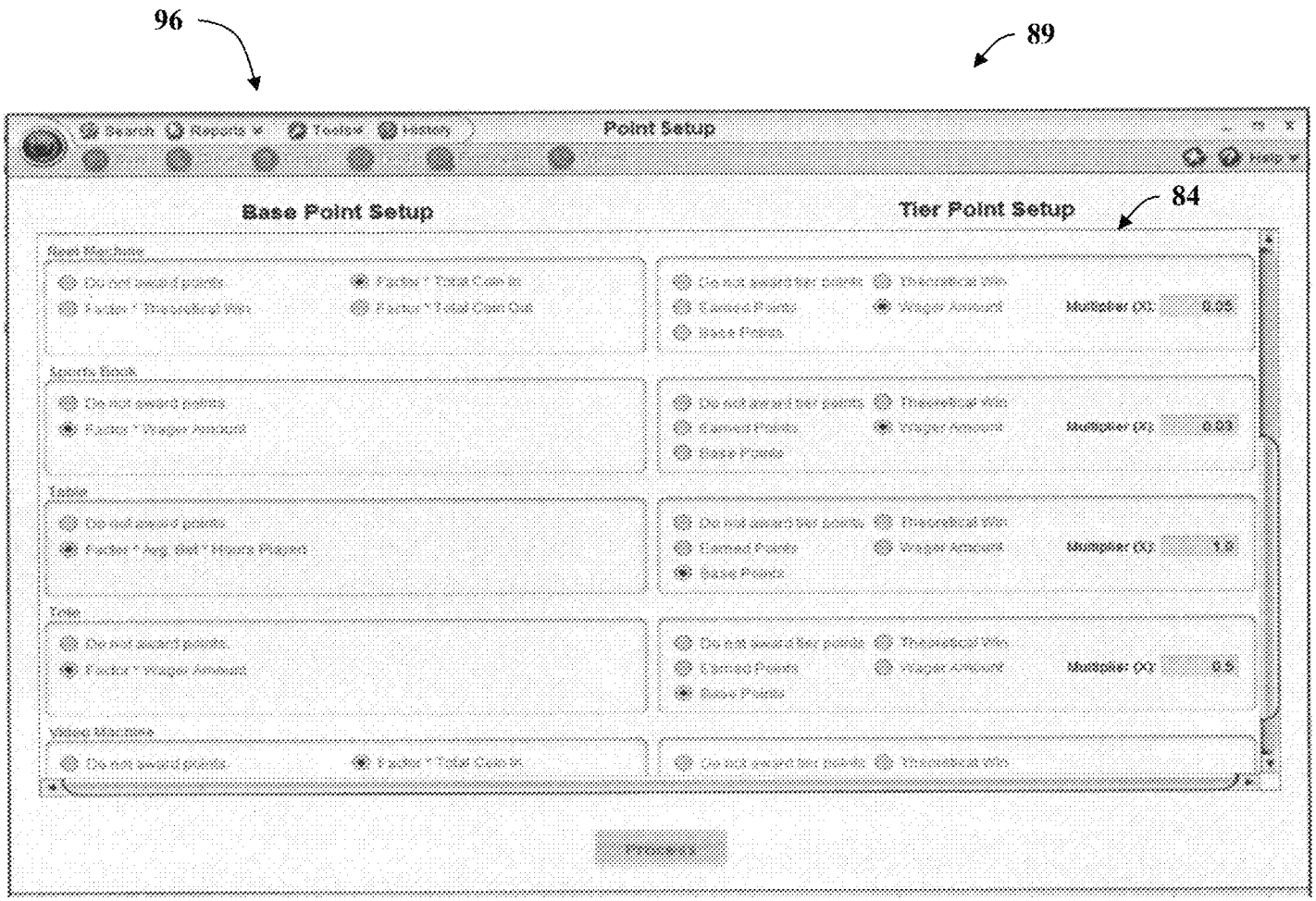

In one embodiment, the patron comp module 76 may be configured to generate and display a patron ranking matrix set-up screen 89 (shown in FIGS. 20-21) on a user computing device to allow a user such as, for example, a casino employee to modify the data included in the patron ranking matrix 82. For example, the patron ranking matrix set-up screen 89 may allow a casino employee to adjust the ADT and Total Theo criteria for each of the corresponding Patron ranking values and/or patron Markets. In addition, the patron comp module 76 may allow a user to adjust any of the data values included in the patron ranking data 84, ranking calculation data 86, and/or comping reinvestment data 88 using the set-up screen.

In the illustrated embodiment, the patron comp module 76 is configured to determine a patron comp award using the patron ranking matrix 82. For example, in one embodiment, the patron may transmit a request for a corresponding patron ranking via the player tracking device 38 and/or user computing device. For example, the patron may request a patron ranking upon initiating a gaming session or after completing a gaming session. In the illustrated embodiment, upon receiving the request from the patron, the patron comp module 76 is configured to access the database 22 and retrieve a player tracking account record 78 that is associated with the patron. For example, the patron comp module 76 may retrieve a player tracking account record 78 associated with the player information including a unique player ID. Upon retrieving the player tracking account record 78, the patron comp module 76 determines the postal code included in the player tracking account record 78 and accesses the patron ranking matrix 82 to determine a Market ID associated with the postal code. Upon determining the Market ID associated with the identified postal code, the patron comp module 76 determines the number of Ranking Days Evaluated associated with the Market ID to determine the ranking evaluation period required for determining the patron ranking. The patron comp module 76 then accesses the player tracking account record 78 to determine and retrieve qualified patron transaction records 80 that include transaction dates that are within the ranking evaluation period. The patron comp module 76 then determines the total amount wagered and/or the total amount purchased during the ranking evaluation period based on the qualified patron transaction records 80. The patron comp module 76 is configured to calculate the ADT and Total Theoretical loss based on the total amount wagered and/or the total amount purchased during the ranking evaluation period, and determines a patron ranking value based on the calculated ADT and Total Theoretical loss. The patron comp module 76 may then display the determined player ranking to the patron via the gaming machine 12, player tracking device 38, and/or user computing device In addition, the patron comp module 76 generates a patron ranking data table 90 (shown in FIG. 11) that includes a plurality of patron ranking records 92 associated with a unique player ID. Each patron ranking record 92 includes data indicating a patron group and ranking, a card level associated with the ranking, a date in which the ranking was assigned, and/or a comp reinvestment value associated with the corresponding patron ranking. The patron comp module 76 may be configured to update the patron ranking data table 90 upon establishing a current patron ranking to maintain a history of patron ranking changes associated with the patron. The patron comp module 76 may also be configured to access and display the patron ranking data table 90 one the gaming machine 12, player tracking device 38, and/or user computing device upon receiving a request from a user such as, for example, the patron and/or a casino employee.

In the illustrated embodiment, the patron comp module 76 is also configured to determine patron comp award based on information included in the patron ranking matrix 82. For example, upon receiving a request from a casino employee, the patron comp module 76 may access the patron ranking data table 90 using the unique player ID and determine a current patron ranking value. The patron comp module 76 may then access the patron ranking matrix 82 to determine the comping reinvestment data associate with the patron ranking. The patron comp module 76 determines a comping evaluation period based on the corresponding comp days evaluated associated with the player ranking, and access the player tracking account record 78 associated with the player ID to determine the total amount wagered and/or purchased during the comping evaluation period. The patron comp module 76 may then determine the patron comp award based on the total amount wagered and/or purchased and the Slot Reinvestment % and Table Game Reinvestment % included in the corresponding player ranking.

For example, in one embodiment, the patron comp module 76 may determine the total amount wagered on slot machines during the comp evaluation period, and determine a comp award by multiplying the determined total amount wagered on slot machines by the Slot Reinvestment %. In another embodiment, the patron comp module 76 may determine a total theoretical loss associated with the total amount wagered on slot machines and determine the comp award by multiplying the total theoretical loss on slot machine wagers by the Slot Reinvestment %. Similarly, the patron comp module 76 may be configured to determine the comp award based on a total amount wagered on table games and the Table Game Reinvestment %, or a total theoretical loss associated with the total amount wagered on table games and the Table Game Reinvestment %. The patron comp module 76 may then credit the determined player comp award to the patrons account as bonus points, gaming credits, and/or any suitable award that may be provided by the casino gaming establishment.

In addition, the patron comp module 76 may be configured to initiate a nightly process to calculate "all" active patrons and place them into a "Rankin" with their current ADT and Total Theo based on the Days Evaluated parameter (minus 1). The patron comp module 76 may also initiate a process that runs every few minutes to evaluate the current "Ranking" based on the previous nightly process data, "plus" any additional rating info collected since the last nightly process. This process will provide a Ranking update based on the "ADT or Total Theo" and "Days Evaluated" criteria. The "target interval" will be approximately every 15 minutes or less, based on process optimization. The patron comp module 76 may also be configured to generate patron rankings based on Dynamic Patron Group assignments and create the groups with a naming convention of "Market name" concatenated with the "Ranking designator", (i.e., "Inner-R1", "Inner-R2", etc.). The Dynamic Patron Groups may be used to generate other incentives and ad-hoc reporting. For example, the patron comp module 76 may also generate Incentives to assign the appropriate comp point multipliers based on the Ranking (Group Assignment). The Groups tab on the Incentive setup form will be used to associate the Groups with the Incentive. The patron comp module 76 may also evaluate each new rating or rating update to determine what incentives are applicable. Since the Rankings will be adjusted every few minutes, "as well as on each rating update or close", it will allow for the incentive to award the point multiplier for the entire rating to be based on the appropriate ranking. The patron comp module 76 may also be configured to generate a view for Postal Code/Address History that is provided in the Data Access Layer (DAL) to provide the necessary fields to join with other existing views to allow for the system to query for the Ranking Change History.

In one embodiment, the system 10 includes a gaming tracking device 94 that is coupled to the gaming device 12 and the middleware server computer 50 to receive gaming property services from the middleware server computer 50 and display the gaming property services on the gaming display 35. Moreover, the gaming tracking device 94 is configured to receive gaming property services from the middleware server computer 50 and transmit services data indicative of the gaming property services to gaming device 12. In one embodiment, the gaming tracking device 94 is a multipurpose EGM/player tracking device that is connected to one or more gaming machines 12C. In one embodiment, the gaming tracking device 94 includes a housing that contains a processor and a display controller configured to control and/or drive the gaming display 35 included with the gaming machine 12C. For example, in one embodiment, the gaming tracking device 94 may be a SYNKBOX™ available from Konami Gaming, Inc. and includes a True Time Windows™ computer program that drives a picture-in-picture gaming display 35. Additional details of multipurpose EGM/player tracking devices, which may be used in the present invention, are described in U.S. patent application Ser. No. 12/235,237 to Edward Sepich et al., now U.S. Pat. No. 8,429,229, filed Sep. 22, 2008, titled "Multipurpose EGM/player Tracking Device and System", which is incorporated herein by reference in its entirety.

In one embodiment, for example, the communication module 72 may be configured to generate and display a web browser interface 96 (shown in FIGS. 13-21) on a client device 12 such as, for example, the gaming machine 12C, using the gaming tracking device 94. The web browser interface 96 enables a player to access the gaming property services via a website provided by the system 10. In one embodiment, the gaming tracking device 94 is configured to receive webpage data indicative of the gaming property services from the communication module 72 and transmit the services webpage to the gaming tracking device 94 for use in displaying the services webpage on the gaming display 35. In addition, the gaming tracking device 94 may be configured to transmit information between the patron and the application processor 70 via the services webpage to facilitate providing gaming property services to the player.

Figure 13:
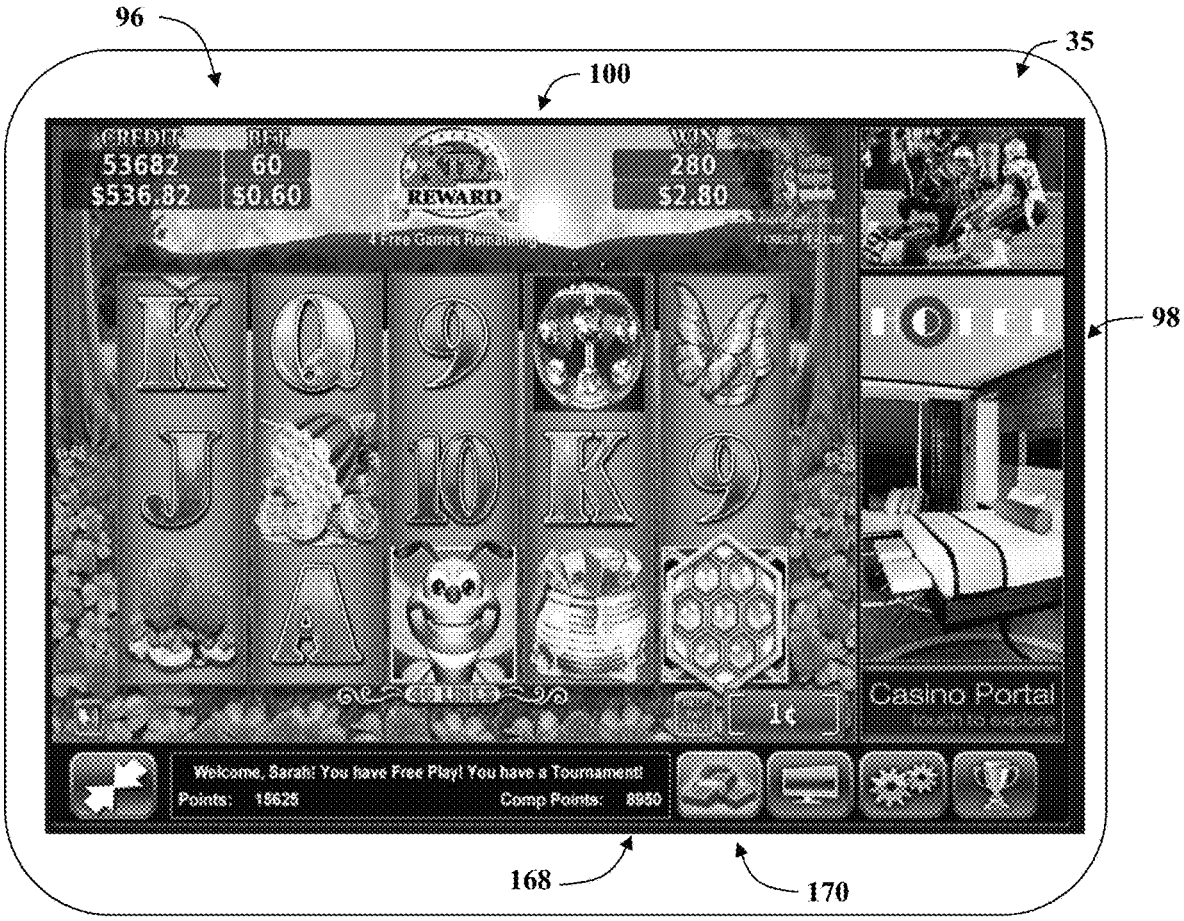
FIGS. 13-21 are graphical displays that may be displayed by the system shown in FIGS. 1, 5, and 6, according to an embodiment of the present invention.
Figure 14:
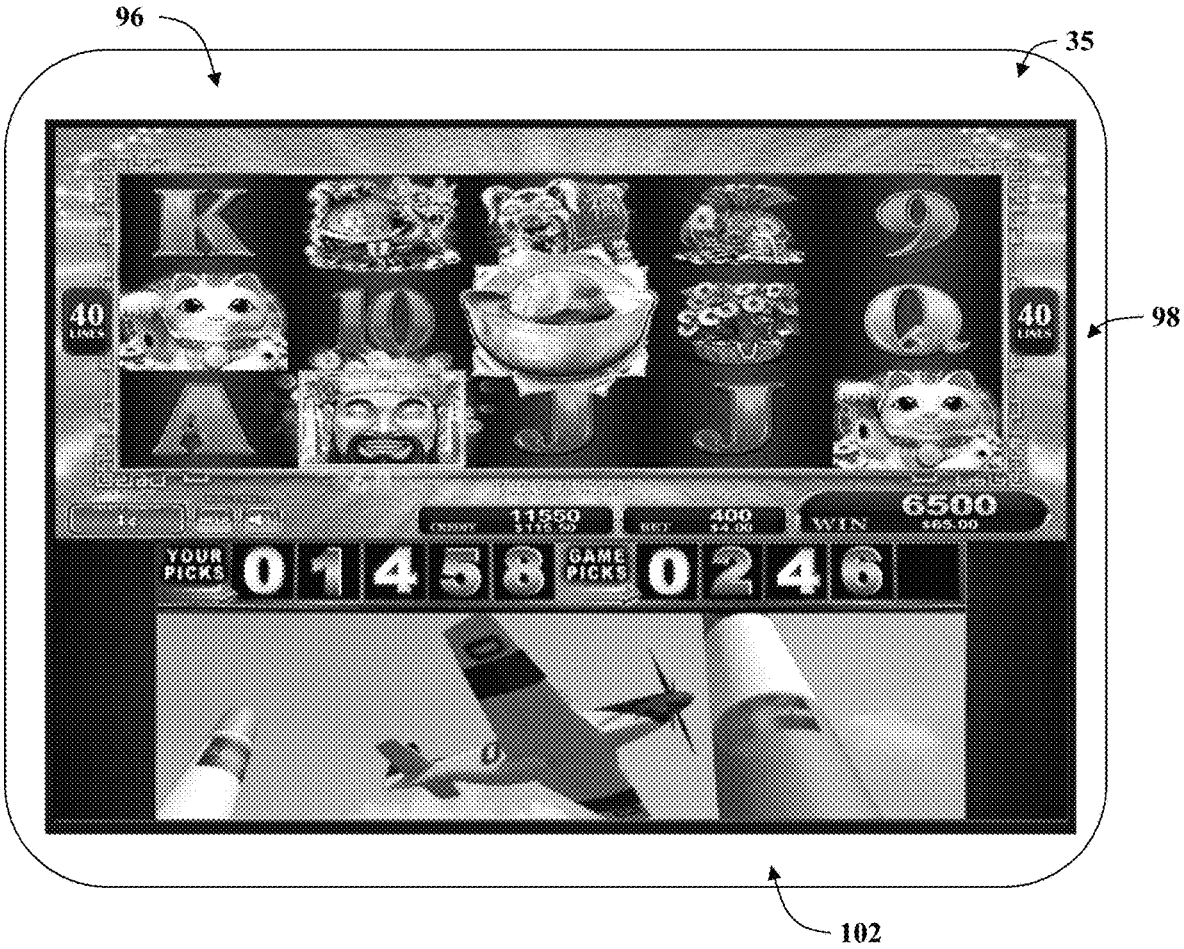
Figure 15:
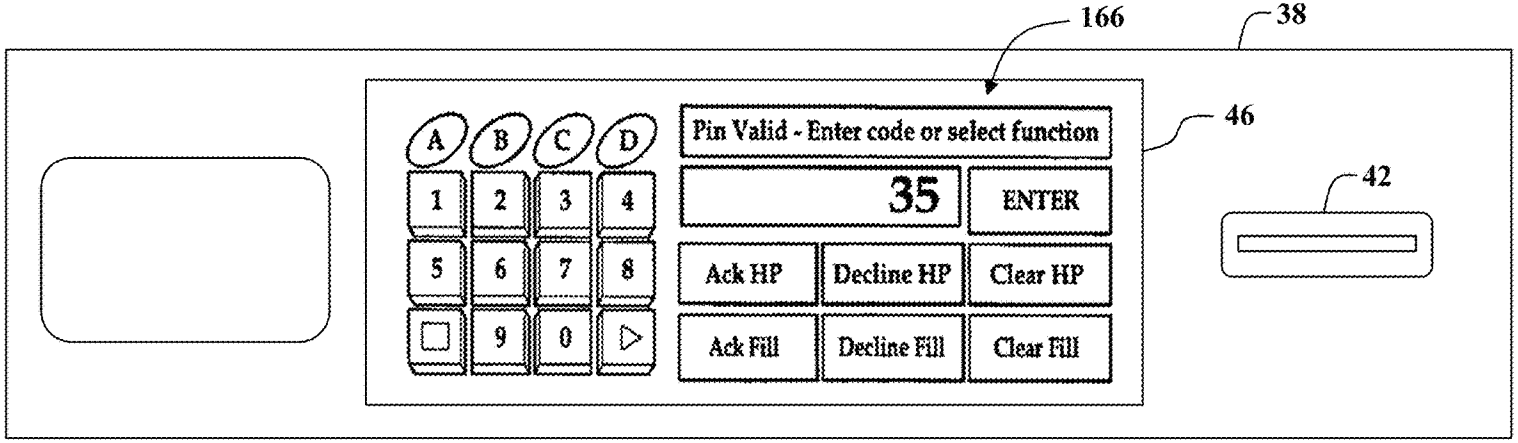
Figure 16:
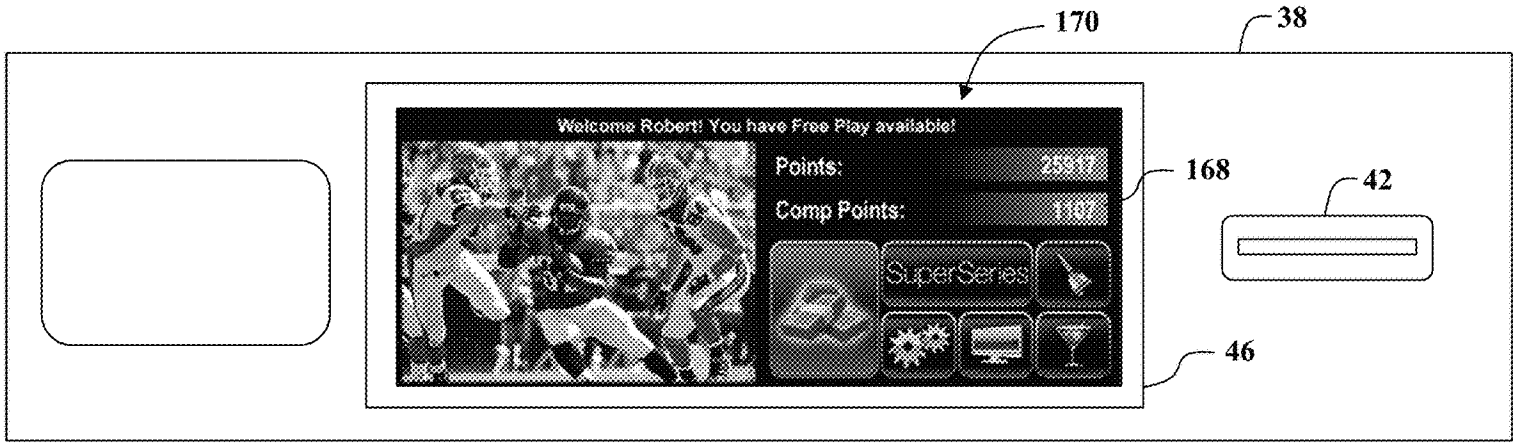
Figure 17:
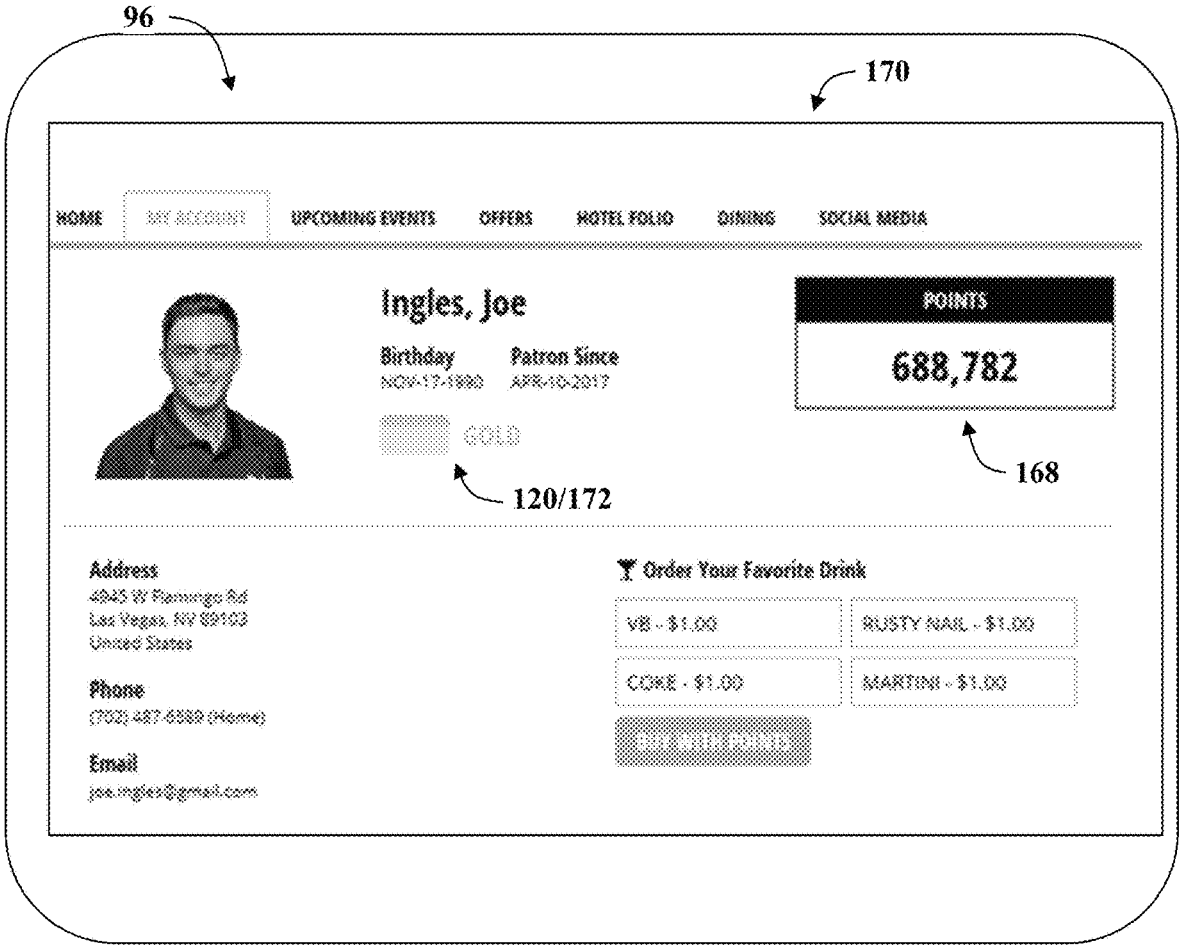
Figure 18:
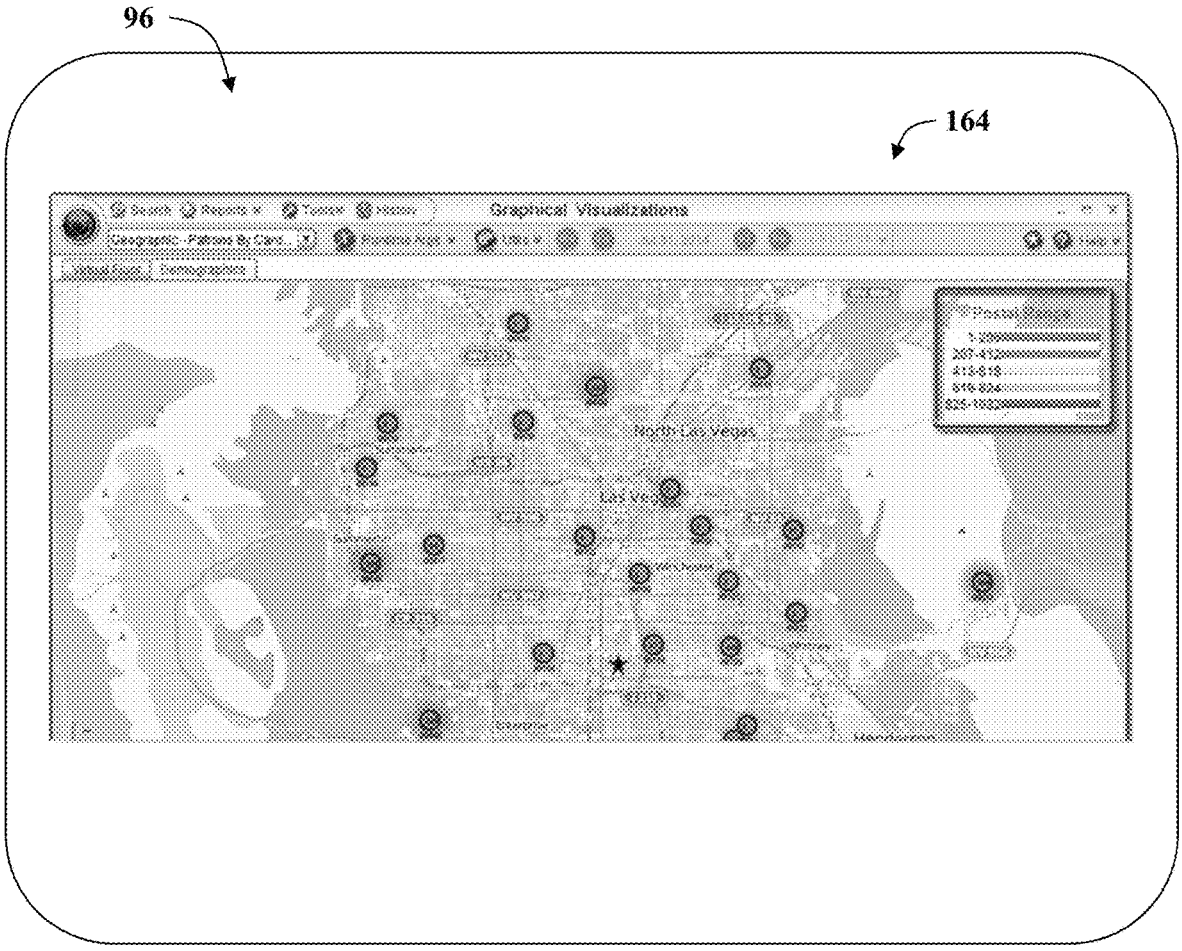

In the illustrated embodiment, the application processor 70 is configured to display a player interaction screen 98 including a gaming content section 100 and a non-gaming content section 102 using a picture-in-picture display (shown in FIGS. 13-14). Moreover, the application processor 70 displays a game being generated by the gaming controller 26 of the gaming machine 12C within the gaming content section 100 and displays a services website in the non-gaming content section 102. Additional details of the gaming tracking device and system components for use in displaying the player interaction screen, which may be used in the present invention, are described in U.S. patent application Ser. No. 14/488,174 to Jeffrey D. George et al., filed Sep. 16, 2014, titled "System and Methods of Providing Player Services with Gaming Devices", which is incorporated herein by reference in its entirety.

In the illustrated embodiment, the database server processor 54 is programmed to generate and store a program file including the patron ranking logic matrix 82 arranged in a spreadsheet in the database 22. The patron ranking logic matrix 82 includes a plurality of rows 104 and a plurality of columns 106. The plurality of rows 104 includes data associated with patron ranking criteria, and each row 104 corresponds to a data record of patron ranking information 108 included in the spreadsheet that includes data associated with patron ranking criteria. The plurality of columns 106 intersect the plurality of rows 104 to define a plurality of logic cells 110. Each column 106 includes a unique object identifier 112. Each logic cell 110 includes a ranking criteria data value 114. In one embodiment, the patron ranking logic matrix 82 includes a column including a market definition value associated with a plurality of postal codes, a column including a patron ranking value, a column including a theoretical loss value associated with the patron ranking value, and a column including comp reinvestment data.

In the illustrated embodiment, the patron ranking logic matrix 82 is generated to include a first column 114 that includes market definition values 116 associated with a plurality of postal codes, a second column 118 that includes patron ranking values 120, a third column 122 that includes average daily theoretical loss values 124 associated with a corresponding patron ranking value 120, a fourth column 126 that includes total theoretical loss values 128 associated with a corresponding patron ranking value 120, a fifth column 130 that includes ranking evaluation period values 132 for determining a patron theoretical loss value, a sixth column 134 that includes slot comp reinvestment percentage values 136 for calculating a patron comp point value based on total wagered amounts associated with slot games, a seventh column 138 that includes table game comp reinvestment percentage values 140 for calculating the patron comp point value based on total wagered amounts associated with table games, and an eighth column 142 that includes comp reinvestment evaluation period values 144 for determining total wagered amounts associated with slot games and total wagered amounts associated with table games for calculating the patron comp point value.

The patron logic matrix 82 also includes a plurality of data record sets 146. Each data record of patron ranking information 108 included in a corresponding data record set 146 includes an identical market definition value 116 and a different patron ranking value 120.

In the illustrated embodiment, the database server processor 54 is programmed to generate and store a program file including the patron data records including the player tracking account records 78 (shown in FIG. 10) in the database 22. Each patron data record 78 includes a unique patron ID 148, patron address information 150 including a postal code 152, and patron wagering data. In one embodiment, each patron data record 78 includes a plurality of patron transaction records 80. Each patron transaction record 78 includes information associated with a gaming transaction including a total wagered amount 154, a type of gaming device 156 used, and a transaction date 158 on which the gaming transaction was made.

The database server processor 54 is also programmed to generate and store a program file including the postal code reference matrix 160 (shown in FIG. 12) in the database 22. The postal code reference matrix 160 includes a plurality of market reference data records 162. Each market reference data record 162 includes a plurality of postal codes 152 associated with a corresponding market definition value 116. In one embodiment, the application processor 70 is programmed to generate a postal code assignment screen 164 (shown in FIG. 18) on a user computing device and/or workstation to allow a user to assign postal codes to the market definition values 116 for use in generating the postal code reference matrix 160.

In the illustrated embodiment, the application processor 70 is programmed to receive a request to generate a patron comp point value from a gaming device 12. For example, in one embodiment, the application processor 70 may display a patron login screen 166 (shown in FIG. 15) on a player tracking device 38 associated with a gaming machine 12C, which requests a patron's unique patron ID to access a player tracking account. The application processor 70 may also display the patron login screen 166 on a non-gaming machine such as, for example, a user computer device 12, an admin workstation 27, and/or kiosk 25. The application processor 70 may obtain the patron's unique patron ID from input received via a numeric keypad displayed with the patron login screen 166, a code contained in a magnetic card strip of a physical card inserted into the card reader of the player tracking device 38, and/or a username and password entered via the patron login screen 166.

Upon receiving the receive a request to generate a patron comp point value including the patron ID, the application processor 70 is programmed to access the plurality of patron data records 78 and retrieve a patron data record 78 having a unique patron ID 148 that matches the received patron ID. The application processor 70 then determines a patron theoretical loss value 124, 128 based on patron wagering data 80 included in the retrieved patron data record 78.

The application processor 70 then identifies the postal code 152 included in the retrieved patron data record 78 and accesses the patron logic matrix 82 to identify the data record set 146 associated with the market definition value 116 associated with a postal code 152 included in the retrieved patron data record 78. In one embodiment, the application processor 70 accesses the postal code reference matrix 160 to identify the market definition value 116 associated with a postal code 152 included in the retrieved patron data record 78.

Figure 19:
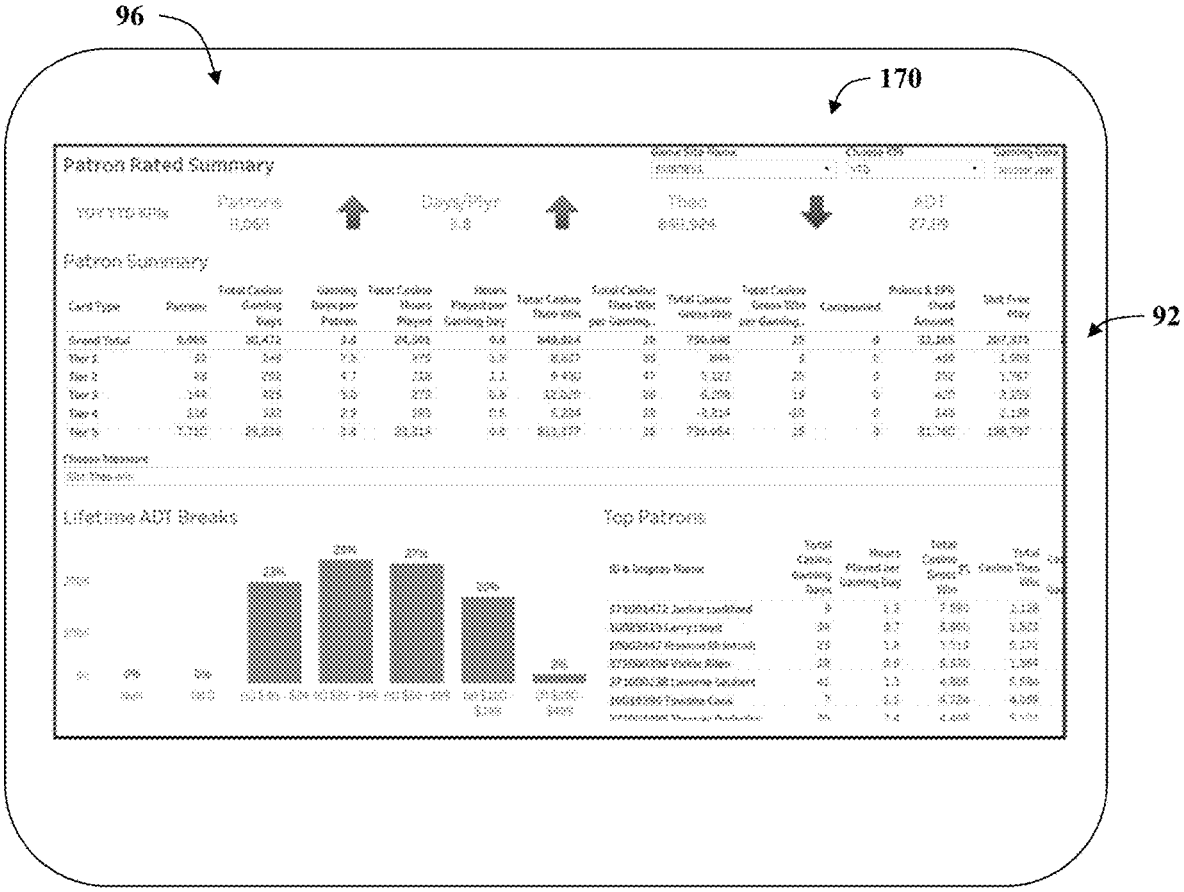

The application processor 70 then selects a data record of patron ranking information 108 included in the identified data record set 146 that has a theoretical loss value associated with the determined patron theoretical loss value, and calculates a patron comp point value 168 (shown in FIGS. 13, 16, and 17) based on comp reinvestment data 88 included in the selected data record of patron ranking information 108 and the patron wager data 80 included in the retrieved patron data record 78. The application processor 70 then generates and displays patron information including the calculated patron comp point value 168 on a display device associated with the gaming device 12. In one embodiment, the application processor 70 may display a patron information screen 170 (shown in FIGS. 13, 16, 17, and 19) that includes the patron comp point value 168. For example, the application processor 70 may be programmed to transmit instructions to the player tracking device 38 to cause the processor of the player tracking device 38 to display the patron information screen 170 including the calculated patron comp point value 168 on the player tracking display device 38. In another embodiment, the patron information screen 170 may be displayed in the non-gaming content section 102 of the player interaction screen 98. In one embodiment, as shown in FIG. 19, the application processor 70 may be programmed to display the patron information screen 170 including the information included in each patron ranking record 92 including the patron group and ranking 120, a card level 172 associated with the ranking, a date in which the ranking was assigned, and/or a comp reinvestment value associated with the corresponding patron ranking.

In one embodiment, the application processor 70 is programmed to identify a patron ranking value 120 associated with the selected data record of patron ranking information 108, and generate a patron ranking data file 90 including the received patron ID 148, the calculated patron comp point value 168, the identified patron ranking value 120, and the market definition value 116 associated with the retrieved patron data record 78. The application processor 70 then transmits instructions to the database server computer 52 which cause the database server processor 54 to store the patron ranking data file 90 in the database 22. In one embodiment, the application processor 70 is programmed to generate and/or modify patron ranking data files 90 for each of the patron data records 78 at predefined time intervals such as, for example, at the end of each day, at 15-minute intervals, and/or any time interval designated by a user.

The application processor 70 may be programmed to generate the patron logic matrix 82 including a column including a ranking evaluation period 132 that is associated with each data record of patron ranking information 108. When determining the patron theoretical loss value, the application processor 70 determines the ranking evaluation period 132 associated with the selected data record of patron ranking information 108, selects patron transaction records 80 from the retrieved patron data record 78 that have transaction dates within the determined ranking evaluation period, and calculates the patron theoretical loss value based on a sum of total wagered amounts included in the selected patron transaction records 80. In one embodiment, when determining the patron theoretical loss value the application processor 70 may retrieve an existing patron ranking data table 90 using the received patron ID and determine a current patron ranking value 120 included in the retrieved patron ranking data file 90. The application processor 70 then selects a data record of patron ranking information 108 included in the identified data record set 146 that has a patron ranking value 120 matching the current patron ranking 120 included in the retrieved patron ranking data file 90, and identifies the ranking evaluation period 132 in the selected data record of patron ranking information 108. The application processor 70 then selects patron transaction records 80 based on the identified ranking evaluation period 132 associated with the current ranking of the patron. The application processor 70 may also use the determined patron theoretical loss value to adjust the current patron ranking value 120 and modify the patron ranking data table 90 to include the adjusted patron ranking value 120. The application processor 70 may be programmed to adjust patron ranking values on a nightly basis, and/or at predefined intervals of time.

In one embodiment, the application processor 70 may also be programmed to generate the patron logic matrix 82 including a column including a comp reinvestment evaluation period 144 associated with each data record of patron ranking information 108. When calculating the patron comp point value 168, the application processor 70 determines the comp reinvestment evaluation period 144 associated with the selected data record of patron ranking information 108, selects patron transaction records 80 from the retrieved patron data record 78 records having transaction dates within the comp reinvestment evaluation period 144, and calculates the patron comp point value 168 based on a sum of total wagered amounts included in patron transaction records 80 having transaction dates 158 within the comp reinvestment evaluation period 144 and the comp reinvestment data 88 included in the selected data record of patron ranking information 108.

In one embodiment, the application processor 70 may be programmed to generate the patron logic matrix 82 including a data record set 146 that has data records of patron ranking information 108 that include a ranking evaluation period 132 that is different than a comp reinvestment evaluation period 144.

The application processor 70 may also be programmed to generate the patron wagering data to include patron transaction records 80 having total wagered amounts associated with slot games, and generate the patron logic matrix 82 including a column including a slot comp reinvestment percentage value 136 associated with each data record of patron ranking information 108. To determine the patron comp point value 168, the application processor 70 is programmed to calculate the patron comp point value 168 based on a sum of total wagered amounts associated with slot games included in the retrieved patron data record 78 and the slot comp reinvestment percentage value 136 included in the selected data record of patron ranking information 108.

In one embodiment, the application processor 70 may be programmed to generate the patron wagering data having patron transaction records 80 that include total wagered amounts associated with table games. The application processor 70 is programmed to generate the patron logic matrix 82 including a column including a table game comp reinvestment percentage value 140 associated with each data record of patron ranking information 108, and to calculate the patron comp point value 168 based on a sum of total wagered amounts associated with table games included in the retrieved patron data record 78 and a table game comp reinvestment percentage value 140 included in the selected data record of patron ranking information 108.

Figure 4:
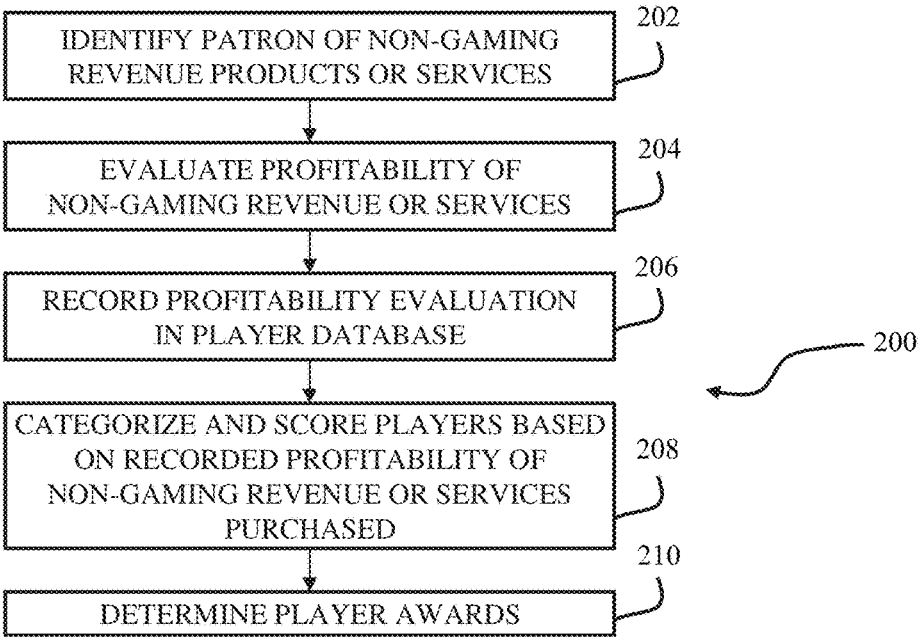
FIG. 4 is a flow diagram of a method for tracking non-gaming activities of a patron at a resort that may be executed by the system shown in FIG. 1, according to an embodiment of the present invention.
Figure 8:
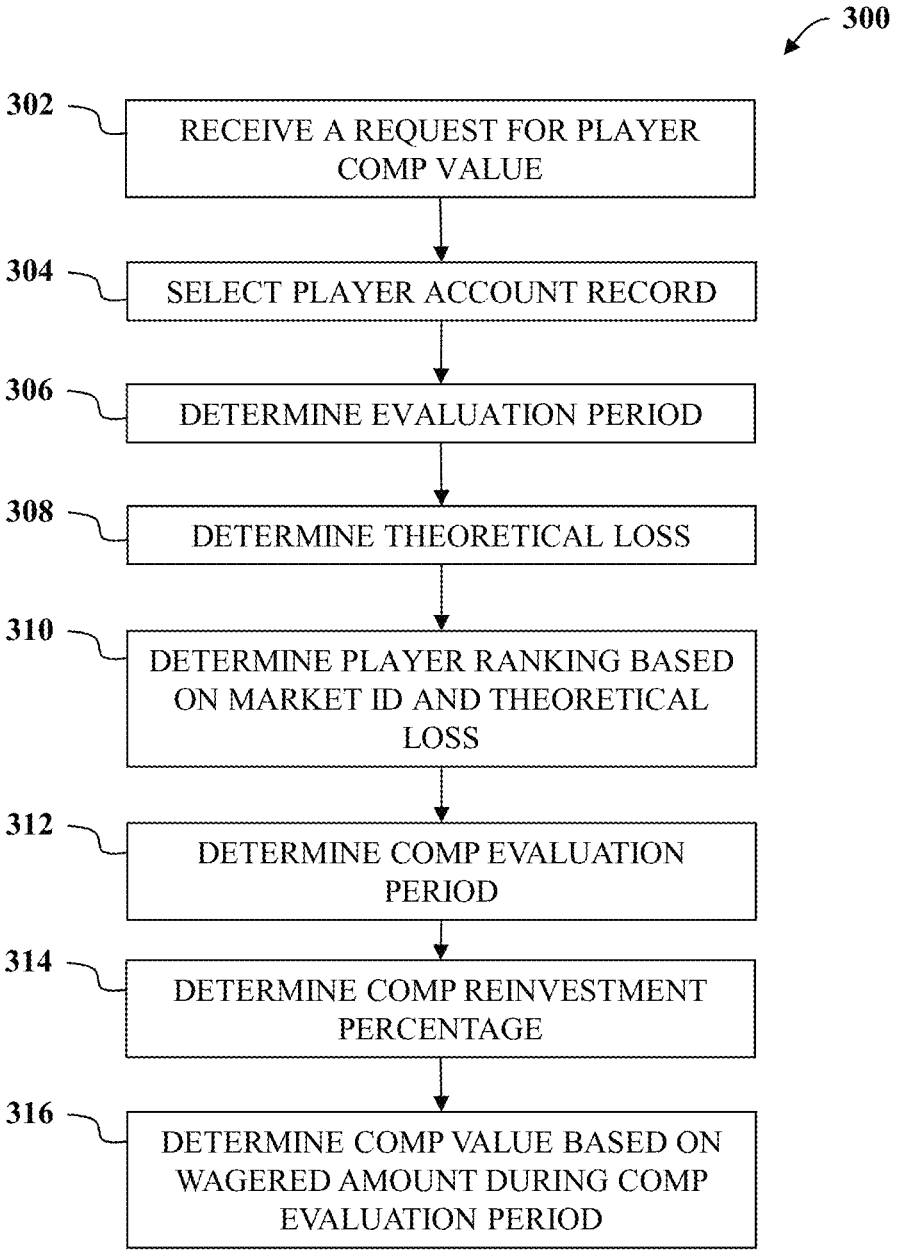
FIG. 8 is a flowchart of a method that may be executed by the system shown in FIGS. 1, 5, and 6, according to an embodiment of the present invention.

FIGS. 4 and 8 are flowcharts of methods 200 and 300 that may be used with the server computer system 18 for use in generating information that may be used to provide gaming property services to a casino patron. The methods 200 and 300 include a plurality of steps. Each method step may be performed independently of, or in combination with, other method steps. Portions of the method 300 may be performed by any one of, or any combination of, the components of the system 10.

Referring to FIG. 4, in one embodiment, in method step 202, the server computer system 18 identifies a patron generating non-gaming revenue by purchasing non-gaming goods and services using one or more non-gaming devices 12. In method step 204, the server computer system 18 evaluates the profitability of the non-gaming revenue or non-gaming services. In method step 206, the server computer system 18 generates a patron transaction record 80 associated with the non-gaming purchase and updates a corresponding player tracking account record 78 stored in the database. In method step 208, the server computer system 18 categorizes and generates a patron ranking and/or player score based on the recorded profitability of the non-gaming revenue or services purchased. In method step 210, the server computer system 18 determines a patron comp award to be provided to the player based on the player ranking and/or player score.

Referring to FIG. 8, in the illustrated embodiment, in method step 302, the server computer system 18 receives a request to generate a player comp value indicating a patron comp award associated with a patron ranking. For example, in one embodiment, the server computer system 18 may receive a request from a patron via a gaming machine 12 and/or player tracking device 38, or receive a request from a patron or casino employee via a user computing device. In one embodiment, the request may include a unique player ID associated with the patron.

In method step 304, the server computer system 18 accesses the database and retrieves a player tracking account record 78 associated with the received unique patron ID.

In method step 306, the server computer system 18 determines a ranking evaluation period that is used to determine a current player ranking. For example, in one embodiment, the server computer system 18 may retrieve a patron ranking data table 90 using the unique player ID and determine a current patron ranking value and Market ID associated with the patron. The server computer system 18 may then access the patron ranking matrix 82 and determine the ranking evaluation period associated with the current patron ranking value and Market ID included in the corresponding patron ranking data table 90.

In method step 308, the server computer system 18 retrieves qualified patron transaction records 80 that include transaction dates that are within the determined ranking evaluation period, determines a total wagered amount within the ranking evaluation period, and determines a theoretical loss based on determined total wagered amount.

In method step 310, the server computer system 18 accesses the patron ranking data table 90 and determines a current patron ranking based on the corresponding Market ID and determined theoretical loss.

In method step 312, the server computer system 18 uses the patron ranking data table 90 and determines the comp evaluation period associated with the current patron ranking.

In method step 314, the server computer system 18 determines the comp reinvestment percentage associated with the patron ranking included in the patron ranking data table 90.

In method step 316, the server computer system 18 retrieves qualified patron transaction records 80 that include transaction dates that are within the determined comp evaluation period, determines a total wagered amount within the comp evaluation period, and determines a comp value based on the total wagered amount within the comp evaluation period and the comp reinvestment percentage.

INDUSTRIAL APPLICABILITY

In a typical casino management system, the table in the database would house gaming ratings. In the present invention, the system stores point of sale transactions related to point redemption and/or earnings. The present invention allows the use of this existing table to handle the "rating" of non-gaming activity. In short, this is done by utilizing the existing interface for point of sale/hotel to capture spend, multiply it by the terminal's margin, and store the estimated profit in the existing theoretical win column. This way, all activity (gaming and non-gaming) can be captured and stored without the need for a separate data warehouse or repository or an extract method to migrate data.

Once the player/patron rating values are determined, the casino may use the data for various marketing or player comp purposes. These could include, but are not limited to:

1. Analysis of an individual patron over time
2. Analysis of a group over time (using average score of the group)
3. Comparative analysis of one group/individual against another [over time or for a specific period]
4. Resolution dispute, updating internal business protocols using the score to determine the nature of the resolution
5. Patron hosting and VIP analysis—to use worth score to determine who should qualify to be a VIP and/or hosted. That analysis could be performed in period report or as a "real-time" on the floor discovery of active patrons currently playing machines
6. To create better segmentation models, using worth as a criteria element. This could replace or enhance existing methodologies that may only use traditional metrics such as theoretical win, average daily theoretical, or coin in/turnover
7. To better determine reinvestment activities based on worth. By way of example, if a property provided parking discounts based on lifetime or periodic worth, the property could use the score as a matrix to determine percentage discount (e.g. everyone with a score above 90 for the period gets 100% discount, 75-89 score gets 50% discount, etc.)
8. Reinvestment, as denoted above, may have had to do with the amount of the reward. It can also be the timing of the reward. For example, if the patron's score is increasing, possibly invest less monies and with less frequency due to human nature dictating that this person is in an "upswing". If the patron's score is decreasing, the inverse is true and the business/property would examine the impact of increasing the amount and/or frequency of certain reinvestment strategies to re-capture that patron's activity potential
9. As an additional factor in determining the issuance of markers and credit limits
10. To evaluate scores as a relationship of market area
11. To determine if an individual player development manager or host has greater impact than another peer in increasing and/or retaining a greater overall score for the patron's assigned to that individual
12. To analyze score in relationship to seasonality, business growth (e.g. new verticals such as hotel or general expansion), competitor influence, shift, and any other internal or external factor that could contribute to a shift in the number of patrons within a given scoring range.

In a first aspect of the present invention, a method is established for identifying a patron who purchases products or services such as, hotel and hospitality, retail, dining, entertainment and/or other non-gaming revenue source related to the casino enterprise whether located locally or remote to the casino property. This method may incorporate the patron presenting a patron tracking ID card, providing a phone number, using a credit card associated with the patron's account or any other means of identifying the patron.

In a second aspect of the present invention, a method is established for determining the profitability (rating) patron's purchase. This method incorporates a technique of evaluating the casino's profit margin on the product and/or service and storing this profit evaluation in the patron tracking system. For example, a patron may purchase a spa package at a certain amount, however, the cost of the spa package is known to casino, and therefore at a minimum the patrons purchase price (rating buy-in), value or pre-discounted price (rating actual buy-in), cost of the product or service (rating walk-with) and casino profitability (rating net profit) are recorded in addition to the date and time of the purchase.

In a third aspect of the present invention, a method is established for determining the category and/or score of patron (ranking) of the patron based on their historical spend and as compared with all other non-gaming revenue patrons.

In a fourth aspect of the present invention, a method is established for using the patron rating and ranking information to establish a system for rewarding the patron with complementary patron tracking points, complementary products and services or a combination thereof.

In a fifth aspect of the present invention, a method is established for evaluating the patrons overall net worth to the gaming operator.

In a sixth aspect of the present invention, a method is established for using overall ranking method for rewarding a patron.

In a seventh aspect of the present invention, a system for tracking patron events at a plurality of devices is provided. The plurality of devices include electronic gaming machines and non-gaming machines. Each game device has a value associated therewith. The value associated with the electronic gaming machines is a theoretical hold of the respective electronic gaming machine. The value associated with the non-gaming machines is an estimated profit of the respective non-gaming machine. The system includes a plurality of player tracking devices and a server or computer. Each player tracking device is associated with one of the electronic gaming machines. The player tracking devices identify patrons interacting with the system, track wagers made by the patrons on the electronic gaming machines and record wager data associated with each wager made by the players and a respective electronic gaming machine in a database. The wager data includes a device type associated with respective gaming machine, an electronic gaming machine identifier, the theoretical hold percentage associated with the respective gaming machine, and an amount of the respective wager. The server is in communication with the player tracking devices and the non-gaming machines for receiving the wager data associated with the one of the patrons and the respective gaming machine from the player tracking device and storing the wager data in a database and, for receiving transaction data associated with a transaction associated with the patrons use of the non-gaming devices and storing the transaction data in the database, and for establishing a player rating associated with each player as a function of the wager data and the transaction data.

In an eighth aspect of the present invention, a method for tracking patron events at a plurality of devices, the plurality of devices including electronic gaming machines and non-gaming machines. Each game device has a value associated therewith. The value associated with the electronic gaming machines is a theoretical hold of the respective electronic gaming machine. The value associated with the non-gaming machines is an estimated profit of the respective non-gaming machine. The method includes the steps of identifying patrons interacting with the gaming machines and tracking wagers made by the patrons on the electronic gaming machines, and recording wager data associated with each wager made by the patrons and a respective electronic gaming machine. The wager data includes a device type associated with the respective gaming machine, an electronic gaming machine identifier, the theoretical hold percentage associated with the respective gaming machine, and an amount of the respective wager. The method also includes the steps of receiving the wager data associated with the one of the patrons and the respective gaming machine and storing the wager data in a database, receiving transaction data associated with a transaction associated with the patrons use of the non-gaming devices and storing the transaction data in the database, and establishing a player rating associated with each player as a function of the wager data and the transaction data.

Obviously, many modifications and variations of the present invention are possible in light of the above teachings. The invention may be practiced otherwise than as specifically described within the scope of the appended claims.

Exemplary embodiments of a system and method for providing gaming property services to a patron are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other monitoring applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor. Processors may execute one or more program applications, such as a web browser (e.g., Microsoft Internet Explorer, Mozilla Firefox, Apple Safari, Google Chrome, and Opera, etc.), to access and view content over a computer network. In particular implementations, the program applications allow a user to enter addresses of specific network resources to be retrieved, such as resources hosted by a networking system. These addresses can be Uniform Resource Locators, or URLs. In addition, once a page or other resource has been retrieved, the client applications may provide access to other pages or records when the user "clicks" on hyperlinks to other resources. By way of example, such hyperlinks may be located within the webpages and provide an automated way for the user to enter the URL of another page and to retrieve that page. A webpage or resource embedded within a webpage, which may itself include multiple embedded resources, may include data records, such as plain textual information, or more complex digitally encoded multimedia content, such as software programs or other code objects, graphics, images, audio signals, videos, and so forth. One prevalent markup language for creating webpages is the Hypertext Markup Language (HTML). Other common web browser-supported languages and technologies include the Extensible Markup Language (XML), the Extensible Hypertext Markup Language (XHTML), JavaScript, Flash, ActionScript, Cascading Style Sheet (CSS), and, frequently, Java.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

In some embodiments, a network, as describe herein, includes a network addressable system that, in various example embodiments, comprises one or more physical servers and data stores. The one or more physical servers are operably connected to a computer network via, by way of example, a set of routers and/or networking switches. In an example embodiment, the functionality hosted by the one or more physical servers may include web or HTTP servers, FTP servers, as well as, without limitation, webpages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), Flash, ActionScript, and the like. Data stores may store content and data relating to, and enabling, operation of the networking system as digital data objects. A data object, in particular implementations, is an item of digital information typically stored or embodied in a data file, database or record. Content objects may take many forms, including: text (e.g., ASCII, SGML, HTML), images (e.g., jpeg, tif and gif), graphics (vector-based or bitmap), audio, video (e.g., mpeg), or other multimedia, and combinations thereof. Content object data may also include executable code objects (e.g., games executable within a browser window or frame), podcasts, etc. Data stores corresponds to one or more of a variety of separate and integrated databases, such as relational databases and object-oriented databases, that maintain information as an integrated collection of logically related records or files stored on one or more physical systems.

For example, the processes described herein may be implemented using hardware components, software components, and/or any combination thereof. By way of example, while embodiments of the present disclosure have been described as operating in connection with a networking web site, various embodiments of the present invention can be used in connection with any communications facility that supports web applications. Furthermore, in some embodiments the term "web service" and "website" may be used interchangeably and additionally may refer to a custom or generalized API on a device, such as a mobile device (e.g., cellular phone, smart phone, personal GPS, personal digital assistance, personal gaming device, etc.), that makes API calls directly to a server. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A non-transitory computer-readable storage media, having computer-executable instructions embodied thereon, wherein when executed by a processor, the computer-executable instructions cause the processor to:

generate and store a program file including a patron logic matrix arranged in a spreadsheet in a computer memory device, the patron logic matrix including:

a plurality of rows including data associated with patron ranking criteria, each row corresponding to a data record of patron ranking information included in the spreadsheet;

a plurality of columns intersecting the plurality of rows to define a plurality of logic cells, each column including a unique object identifier, each logic cell including a ranking criteria data value;

wherein each data record of patron ranking information includes a column including a market definition value associated with a plurality of postal codes, a column including a patron ranking value, a column including a theoretical loss value associated with the patron ranking value, and a column including comp reinvestment data; and wherein the patron logic matrix includes a plurality of data record sets, each data record of patron ranking information included in a corresponding data record set including an identical market definition value and a different patron ranking value;

generate and store a plurality of patron data records in the computer memory device, each patron data record including a unique patron ID, patron address information including a postal code, and patron wagering data;

receive a request to generate a patron comp point value from a gaming device, the request including a patron ID;

access the plurality of patron data records and retrieve a patron data record having a unique patron ID matching the received patron ID;

determine a patron theoretical loss value based on patron wagering data included in the retrieved patron data record;

access the patron logic matrix and identify the data record set associated with the market definition value associated with a postal code included in the retrieved patron data record;

select a data record of patron ranking information included in the identified data record set having a theoretical loss value associated with the determined patron theoretical loss value;

calculate a patron comp point value based on comp reinvestment data included in the selected data record of patron ranking information and the patron wager data included in the retrieved patron data record; and generate and display patron information including the calculated patron comp point value on a display device associated with the gaming device.

2. The non-transitory computer-readable storage media of claim 1, wherein the computer-executable instructions cause the processor to:

identify a patron ranking value associated with the selected data record of patron ranking information; and generate and store patron ranking data file in the computer memory device including the received patron ID, the calculated patron comp point value, the identified patron ranking value, and the market definition value associated with the retrieved patron data record.

3. The non-transitory computer-readable storage media of claim 2, wherein the computer-executable instructions cause the processor to:

generate a patron ranking data file for each of the patron data records at predefined time intervals.

4. The non-transitory computer-readable storage media of claim 1, wherein the computer-executable instructions cause the processor to:

generate and store a postal code reference matrix in the computer memory device, the postal code reference matrix including a plurality of market reference data records, each market reference data record including a plurality of postal codes associated with a corresponding market definition value; and access the postal code reference matrix and identify the market definition value associated with a postal code included in the retrieved patron data record.

5. The non-transitory computer-readable storage media of claim 1, wherein the computer-executable instructions cause the processor to:

generate the patron wagering data included in each patron data record to include a plurality of patron transaction records, each patron transaction record including information associated with a gaming transaction including a total wagered amount, a type of gaming device used, and a transaction date on which the gaming transaction was made;

generate the patron logic matrix including a column including a ranking evaluation period associated with each data record of patron ranking information;

determine the ranking evaluation period associated with the selected data record of patron ranking information;

select patron transaction records from the retrieved patron data record having transaction dates within the determined ranking evaluation period; and determine the patron theoretical loss value based on a sum of total wagered amounts included in the selected patron transaction records.

6. The non-transitory computer-readable storage media of claim 1, wherein the computer-executable instructions cause the processor to:

generate the patron logic matrix including a column including a comp reinvestment evaluation period associated with each data record of patron ranking information;

determine the comp reinvestment evaluation period associated with the selected data record of patron ranking information;

select patron transaction records from the retrieved patron data record; and calculate the patron comp point value based on a sum of total wagered amounts included in patron transaction records having transaction dates within the comp reinvestment evaluation period and the comp reinvestment data included in the selected data record of patron ranking information.

7. The non-transitory computer-readable storage media of claim 1, wherein the computer-executable instructions cause the processor to:

generate the patron logic matrix including a data record set having data records of patron ranking information including a ranking evaluation period that is different than a comp reinvestment evaluation period.

8. The non-transitory computer-readable storage media of claim 1, wherein the computer-executable instructions cause the processor to:

generate the patron wagering data including patron transaction records having total wagered amounts associated with slot games;

generate the patron logic matrix including a column including a slot comp reinvestment percentage value associated with each data record of patron ranking information; and calculate the patron comp point value based on a sum of total wagered amounts associated with slot games included in the retrieved patron data record and the slot comp reinvestment percentage value included in the selected data record of patron ranking information.

9. The non-transitory computer-readable storage media of claim 8, wherein the computer-executable instructions cause the processor to:

generate the patron wagering data including patron transaction records having total wagered amounts associated with table games;

generate the patron logic matrix including a column including a table game comp reinvestment percentage value associated with each data record of patron ranking information; and calculate the patron comp point value based on a sum of total wagered amounts associated with table games included in the retrieved patron data record and a table game comp reinvestment percentage value included in the selected data record of patron ranking information.

10. A casino management networked computer system, comprising:

a database server computer including a database server processor coupled to a database memory device, the database server processor programmed to:

generate and store a program file including a patron logic matrix arranged in a spreadsheet in the database memory device, the patron logic matrix including:

a plurality of rows including data associated with patron ranking criteria, each row corresponding to a data record of patron ranking information included in the spreadsheet;

a plurality of columns intersecting the plurality of rows to define a plurality of logic cells, each column including a unique object identifier, each logic cell including a ranking criteria data value;

wherein each data record of patron ranking information includes a column including a market definition value associated with a plurality of postal codes, a column including a patron ranking value, a column including a theoretical loss value associated with the patron ranking value, and a column including comp reinvestment data; and wherein the patron logic matrix includes a plurality of data record sets, each data record of patron ranking information included in a corresponding data record set including an identical market definition value and a different patron ranking value; and generate and store a plurality of patron data records in the database memory device, each patron data record including a unique patron ID, patron address information including a postal code, and patron wagering data; and an application server computer coupled to the database server computer and to a plurality of gaming devices, the application server computer including an application processor that is programmed to:

receive a request to generate a patron comp point value from a gaming device, the request including a patron ID;

access the plurality of patron data records and retrieve a patron data record having a unique patron ID matching the received patron ID;

determine a patron theoretical loss value based on patron wagering data included in the retrieved patron data record;

access the patron logic matrix and identify the data record set associated with the market definition value associated with a postal code included in the retrieved patron data record;

select a data record of patron ranking information included in the identified data record set having a theoretical loss value associated with the determined patron theoretical loss value;

calculate a patron comp point value based on comp reinvestment data included in the selected data record of patron ranking information and the patron wager data included in the retrieved patron data record; and generate and display patron information including the calculated patron comp point value on a display device associated with the gaming device.

11. The networked computer system of claim 10, wherein the application processor is programmed to:

identify a patron ranking value associated with the selected data record of patron ranking information;

generate a patron ranking data file including the received patron ID, the calculated patron comp point value, the identified patron ranking value, and the market definition value associated with the retrieved patron data record; and transmit instructions to the database server computer to cause the database server processor to store the patron ranking data file in the database memory device.

12. The networked computer system of claim 11, wherein the application processor is programmed to generate a patron ranking data file for each of the patron data records at predefined time intervals.

13. The networked computer system of claim 10, wherein the database computer processor is programmed to generate and store a postal code reference matrix in the database memory device, the postal code reference matrix including a plurality of market reference data records, each market reference data record including a plurality of postal codes associated with a corresponding market definition value; and wherein the application processor is programmed to access the postal code reference matrix and identify the market definition value associated with a postal code included in the retrieved patron data record.

14. The networked computer system of claim 10, wherein the application processor is programmed to:

generate the patron wagering data included in each patron data record to include a plurality of patron transaction records, each patron transaction record including information associated with a gaming transaction including a total wagered amount, a type of gaming device used, and a transaction date on which the gaming transaction was made;

generate the patron logic matrix including a column including a ranking evaluation period associated with each data record of patron ranking information;

determine the ranking evaluation period associated with the selected data record of patron ranking information;

select patron transaction records from the retrieved patron data record having transaction dates within the determined ranking evaluation period; and determine the patron theoretical loss value based on a sum of total wagered amounts included in the selected patron transaction records.

15. The networked computer system of claim 10, wherein the application processor is programmed to:

generate the patron logic matrix including a column including a comp reinvestment evaluation period associated with each data record of patron ranking information;

determine the comp reinvestment evaluation period associated with the selected data record of patron ranking information;

select patron transaction records from the retrieved patron data record; and calculate the patron comp point value based on a sum of total wagered amounts included in patron transaction records having transaction dates within the comp reinvestment evaluation period and the comp reinvestment data included in the selected data record of patron ranking information.

16. The networked computer system of claim 10, wherein the application processor is programmed to generate the patron logic matrix including a data record set having data records of patron ranking information including a ranking evaluation period that is different than a comp reinvestment evaluation period.

17. The networked computer system of claim 10, wherein the application processor is programmed to:

generate the patron wagering data including patron transaction records having total wagered amounts associated with slot games;

generate the patron logic matrix including a column including a slot comp reinvestment percentage value associated with each data record of patron ranking information; and calculate the patron comp point value based on a sum of total wagered amounts associated with slot games included in the retrieved patron data record and the slot comp reinvestment percentage value included in the selected data record of patron ranking information.

18. The networked computer system of claim 17, wherein the application processor is programmed to:

generate the patron wagering data including patron transaction records having total wagered amounts associated with table games;

generate the patron logic matrix including a column including a table game comp reinvestment percentage value associated with each data record of patron ranking information; and calculate the patron comp point value based on a sum of total wagered amounts associated with table games included in the retrieved patron data record and a table game comp reinvestment percentage value included in the selected data record of patron ranking information.

19. The networked computer system of claim 10, wherein the gaming device includes a player tracking device coupled to a gaming machine, the player tracking device including a player tracking display device, the application processor programmed to transmit instructions to the player tracking device to cause the processor of the player tracking device to display the patron information including the calculated patron comp point value on the player tracking display device.

20. A server computer for use in a casino management networked computer system, comprising:

a database; and a processor coupled to the database, the processor programmed to:

generate and store a program file including a patron logic matrix arranged in a spreadsheet in the database, the patron logic matrix including:

a plurality of rows including data associated with patron ranking criteria, each row corresponding to a data record of patron ranking information included in the spreadsheet; and a plurality of columns intersecting the plurality of rows to define a plurality of logic cells, each column including a unique object identifier, each logic cell including a ranking criteria data value;

wherein patron logic matrix includes:

a first column including market definition values associated with a plurality of postal codes;

a second column including patron ranking values;

a third column including average daily theoretical loss values associated with a corresponding patron ranking value;

a fourth column including total theoretical loss values associated with a corresponding patron ranking value;

a fifth column including ranking evaluation period values for determining a patron theoretical loss value;

a sixth column including slot comp reinvestment percentage values for calculating a patron comp point value based on total wagered amounts associated with slot games;

a seventh column including table game comp reinvestment percentage values for calculating the patron comp point value based on total wagered amounts associated with table games; and an eighth column including comp reinvestment evaluation period values for determining total wagered amounts associated with slot games and total wagered amounts associated with table games for calculating the patron comp point value; and wherein the patron logic matrix includes a plurality of data record sets, each data record of patron ranking information included in a corresponding data record set including an identical market definition value and a different patron ranking value.

* * * * *